US007743709B2

(12) United States Patent
Kolnik et al.

(10) Patent No.: US 7,743,709 B2
(45) Date of Patent: Jun. 29, 2010

(54) SABOT FOR ELASTOMERIC PROJECTILE

(75) Inventors: Joseph P. Kolnik, Holladay, UT (US); George M. Elsom, Buffalo, WY (US)

(73) Assignee: Integrity Ballistics, LLC, Boise, ID (US)

( * ) Notice: Subject to any disclaimer, the term of this patent is extended or adjusted under 35 U.S.C. 154(b) by 450 days.

(21) Appl. No.: 11/927,216

(22) Filed: Oct. 29, 2007

(65) Prior Publication Data

US 2010/0095863 A1 Apr. 22, 2010

Related U.S. Application Data

(60) Provisional application No. 60/854,993, filed on Oct. 28, 2006.

(51) Int. Cl.
*F42B 14/06* (2006.01)

(52) U.S. Cl. ..... 102/521; 102/522

(58) Field of Classification Search ..... 102/520, 102/521, 522, 523
See application file for complete search history.

(56) References Cited

U.S. PATENT DOCUMENTS

| | | | | |
|---|---|---|---|---|
| 3,099,958 | A | 8/1963 | Daubenspeck et al. | |
| 3,164,092 | A | 1/1965 | Reed et al. | |
| 3,653,326 | A | 4/1972 | Howsam et al. | |
| 3,710,720 | A | 1/1973 | Mawhinney | |
| 3,738,279 | A | 6/1973 | Eyre et al. | |
| 3,865,038 | A | 2/1975 | Barr | |
| 3,952,662 | A | 4/1976 | Greenlees | |
| 4,290,365 | A | 9/1981 | Dreyer | |
| 4,296,687 | A | 10/1981 | Garrett | |
| 4,434,718 | A | 3/1984 | Kopsch et al. | |
| 4,850,279 | A * | 7/1989 | Fuchs et al. | 102/521 |
| 4,936,219 | A * | 6/1990 | Mudd | 102/520 |
| 4,942,818 | A | 7/1990 | Saxby | |
| 5,016,536 | A | 5/1991 | Brighton | |
| 5,225,628 | A | 7/1993 | Heiny | |
| 5,339,743 | A | 8/1994 | Scarlata | |
| 5,361,700 | A | 11/1994 | Carbone | |
| 5,361,701 | A | 11/1994 | Stevens | |
| 5,375,529 | A | 12/1994 | Knight, Jr. et al. | |
| 5,450,795 | A | 9/1995 | Adelman | |
| 5,493,974 | A | 2/1996 | Bilgeri | |

(Continued)

FOREIGN PATENT DOCUMENTS

| | | |
|---|---|---|
| GB | 2 192 258 A | 1/1988 |

(Continued)

*Primary Examiner*—J. Woodrow Eldred
(74) *Attorney, Agent, or Firm*—Workman Nydegger

(57) ABSTRACT

A sabot includes a base and a plurality of elongated petals extending therefrom. Each petal includes an elongated sidewall portion having an arched interior surface and an arched exterior surface each extending between a first end and an opposing second end. A floor portion inwardly projects from the interior surface of the sidewall portion at the second end thereof so as to form an inside angle between the interior surface of the sidewall portion and an interior surface of the floor portion, each floor portion being pivotally connected to the base so that the plurality of petals can selectively move between a collapsed position wherein the sidewall portions combine to formal a substantially cylindrical sidewall that bounds a chamber and an expanded position wherein the sidewall portions radially outwardly project from the base.

11 Claims, 15 Drawing Sheets

U.S. PATENT DOCUMENTS

| | | | | |
|---|---|---|---|---|
| 5,589,658 | A | 12/1996 | Sanvestre | |
| 5,621,187 | A | 4/1997 | Kearns | |
| 5,723,810 | A | 3/1998 | Sauvestre | |
| 5,874,689 | A | 2/1999 | Alkhatib et al. | |
| 5,880,398 | A | 3/1999 | Crilly et al. | |
| 5,936,190 | A | 8/1999 | Buzick | |
| 5,944,621 | A | 8/1999 | Tsujinaka et al. | |
| 5,970,878 | A | 10/1999 | Gardner | |
| 5,979,330 | A | 11/1999 | Cornell | |
| 6,010,412 | A | 1/2000 | Moriyama | |
| 6,012,395 | A | 1/2000 | Saxby | |
| 6,189,253 | B1 | 2/2001 | Knight et al. | |
| 6,202,562 | B1 | 3/2001 | Brunn et al. | |
| 6,283,037 | B1 | 9/2001 | Sclafani | |
| 6,295,933 | B1 | 10/2001 | Dubocage et al. | |
| 6,302,028 | B1 | 10/2001 | Guillot-Ulmann et al. | |
| 6,371,028 | B2 | 4/2002 | Saxby | |
| 6,374,742 | B1 | 4/2002 | Brunn et al. | |
| 6,481,356 | B2 | 11/2002 | Gualandi | |
| 6,637,143 | B1 | 10/2003 | Wykle | |
| 6,779,463 | B2 | 8/2004 | Mutascio et al. | |
| 6,814,006 | B2 * | 11/2004 | Johansson | 102/522 |
| 6,829,997 | B1 | 12/2004 | Hilleman | |
| 7,150,229 | B2 | 12/2006 | Gardner | |
| 7,549,376 | B1 * | 6/2009 | Grossman et al. | 102/473 |
| 2003/0116051 | A1 | 6/2003 | Kravel et al. | |
| 2005/0188880 | A1 | 9/2005 | Meyer et al. | |
| 2006/0260500 | A1 | 11/2006 | Engel et al. | |
| 2007/0119330 | A1 | 5/2007 | McMurray et al. | |
| 2007/0144397 | A1 | 6/2007 | Hall | |

FOREIGN PATENT DOCUMENTS

| | | |
|---|---|---|
| WO | WO 95/14207 | 5/1995 |
| WO | WO 2005/084161 A2 | 9/2005 |

* cited by examiner

SABOT FOR ELASTOMERIC PROJECTILE

CROSS-REFERENCE TO RELATED APPLICATIONS

The present application claims priority to U.S. Provisional Patent Application No. 60/854,993, filed Oct. 28, 2006, which is incorporated herein by specific reference.

BACKGROUND OF THE INVENTION

1. The Field of the Invention

The present invention relates to sabots used with elastomeric projectiles, projectile cartridges containing an elastomeric projectile, and methods and systems for making projectile cartridges containing an elastomeric projectile.

2. The Relevant Technology

Sabots are commonly used within shotgun shells and some rigid bullet cartridges to provide a gas seal between the exploding propellant and the projectile and to stabilize the projectile during the firing process. A typical sabot used in shotgun shells comprises a tubular sleeve that bounds a compartment and has a floor formed at one end thereof. Spaced apart, longitudinal slits are formed on the sleeve at the end opposite the floor so as to form a plurality of leaves. The sabot is positioned within the outer shell above the exploding propellant and the projectile or shot is positioned within the compartment of sabot. When the shell is fired, the projectile and sabot concurrently travel down the length of the shotgun barrel. As the sabot exits the barrel, the leaves on the sabot radially, outwardly expand causing the sabot to slow and separate from the projectile. Sabots have been used for single body projectiles such as slugs, bullets and fin stabilized darts or rockets. In these alternative embodiments, the sabots can either separate from the projectile directly after exiting the barrel or become part of the projectile to increase the desired aerodynamic properties.

Although conventional sabots are useful in the launching of standard projectiles as discussed above, conventional sabots are not designed for use with elastomeric projectiles. Elastomeric, non-lethal projectiles are projectiles made from a flexible, elastomeric material that expands on impact to debilitate a recipient by not produce terminal injury. However, due to the unique properties of elastomeric projectiles, such projectiles can be difficult to load into conventional sabots and conventional sabots can impede the discharge or trajectory of such projectiles.

Furthermore, the prior art encompasses numerous methods and machines for loading projectiles. However, such prior art methods and machines are not designed for loading very elastic projectiles of high surface friction where the diameter of the projectile is larger than the diameter of the shell into which it is being loaded.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
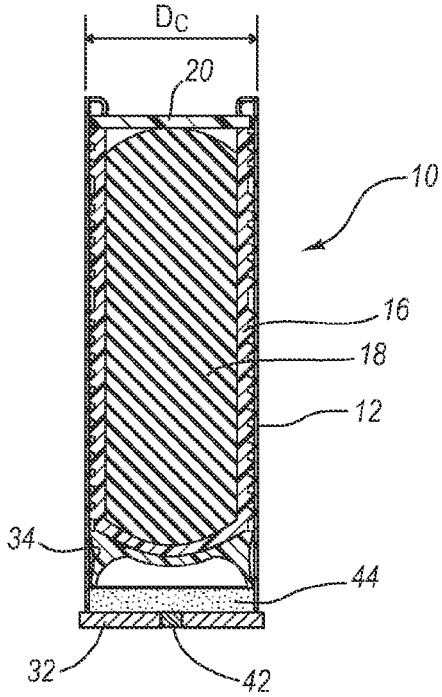
FIG. 1 is a cross sectional side view of one embodiment of a projectile cartridge incorporating features of the present invention.
Figure 2:
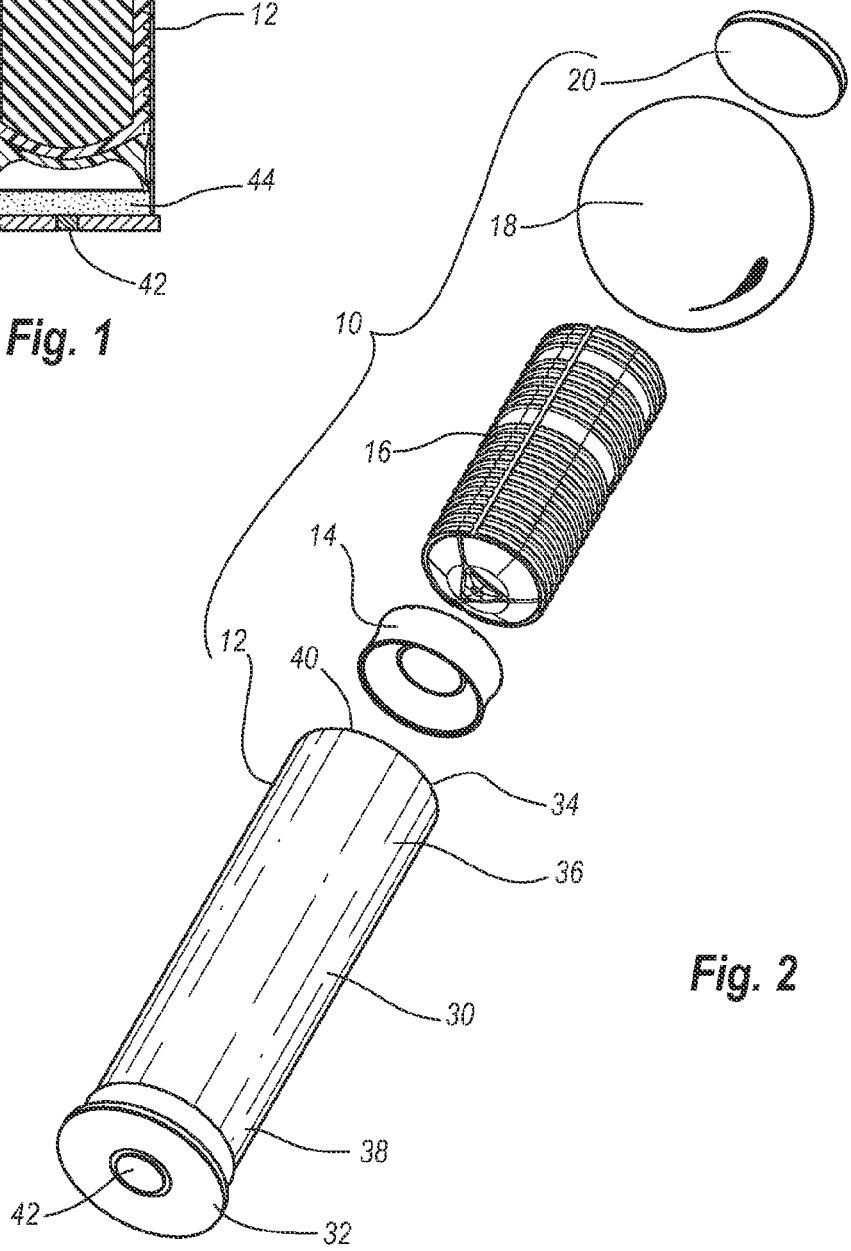
FIG. 2 is an exploded perspective view of the projectile cartridge shown in FIG. 1.

Depicted in FIG. 1 is one embodiment of a projectile cartridge 10 incorporating features of the present invention. By way of a general overview, as depicted in FIGS. 1 and 2, cartridge 10 comprises a casing 12 such as that used in a conventional shotgun cartridge. Casing 12 includes a tubular sleeve 30 having a base 32 mounted on one end thereof. Base 32 holds a primer 42 that ignites a charge 44 upon detonation, as is well known. Positioned within casing 12 is an expandable sabot 16 that houses a projectile 18. A gas seal wad 14 is disposed between sabot 16 and charge 44 while an overshot card 20 is disposed on top of sabot 16. Finally, the free end of casing 12 is crimped over the top of overshot card 20.

Upon ignition of charge 44 by primer 42, the expanding gas produced by charge 44 pushes against gas seal wad 14 which in turn drives sabot 16 and enclosed projectile 18 out of casing 12 and down the length of the gun barrel. Once sabot 16 and enclosed projectile 18 exit the end of the gun barrel, sabot 16 openly expands casing separation between projectile 18 and sabot 16. Projectile 18 then freely travels to the final target.

With regard to projectile 18, in one embodiment projectile 18 comprises a non-lethal projectile having a substantially spherical shape with a diameter larger than the width of casing 12. Projectile 18 is capable of striking a target with a large amount of kinetic energy while maintaining a low pressure spike. Projectile 18 can accomplishes this feat in two ways. First, projectile 18 is made of a sufficiently resilient material as to deform upon impact. The deformation happens along the radius of projectile 18, which becomes larger and flatter, thus reducing the imparted force per unit area. Second, projectile 18 absorbs a quantified amount of energy within its molecular structure while accommodating this new deformed state. As used herein, the term "pressure spike" refers to pressure plotted over time. Thus, with a lower pressure spike, the energy is distributed over a greater period of time than with a high pressure spike.

Projectile 18 is typically comprised of a low durometer polymeric material, or a combination of a low durometer polymeric material and a relatively higher durometer polymeric material, and a heavy-metal powder that is homogeneously dispersed therein. In one embodiment, the low durometer material is a thermoplastic elastomer (TPE) with a density ranging from 0.86 to 0.90 grams per cubic centimeter, and the metal powder is tungsten, which has a specific gravity (S.G.) of 19.3. Optionally, natural rubber can be added to the TPE to increase resiliency. In alternative embodiments, the TPE can have a density ranging from about 0.8 grams per cubic centimeter to about 1.2 grams per cubic centimeter with about 0.80 grams per cubic centimeter to about 0.90 grams per cubic centimeter being more common. Other densities can also be used. The TPE typically has a durometer in a range between about 30 Shore 00 to about 30 Shore A with about 30 Shore 00 to about 15 Shore A being more common. Other values can also be used. Other metal powders that can be used are rhenium (S.G. 21), lead (S.G. 11.35), bismuth (S.G. 9.781), copper (S.G. 8.94), nickel (S.G. 8.9), iron (S.G. 7.87), and zinc (S.G. 7.13). Tungsten is a desirable metal because of its relatively high specific gravity; if tungsten were not used, the volumetric ratio of metal powder to TPE would increase, which in turn could compromise the strength of the composite material. In one embodiment, the particle size of the tungsten is in a range from about 50 microns to about 250 microns. Other particles sizes can also be used. Although the specific gravity of rhenium is greater than that of tungsten, the price of rhenium is currently prohibitive for its use in the present invention.

Alternatively, instead of using only a single low durometer material, the projectile of the present invention may be comprised of a low durometer material combined with a relatively higher durometer material. In this embodiment, the metal powder is evenly distributed throughout the relatively higher durometer material, which in turn is then combined with the lower durometer material to form projectile 18. The relatively higher durometer material may be a natural rubber, a polyurethane, or a thermoplastic elastomer with a durometer preferably in the range of 0 Shore A to 80 Shore A.

One common material hardness or durometer for the composite material is less than 30 Shore A or less than 15 Shore A or in a range from about 30 Shore 00 to about 30 Shore A with about 30 Shore 00 to about 15 Shore A being more common. Other values can also be used. One common density of the composite material is from about 1.5 grams per cubic centimeter to about 9.5 grams per cubic centimeter with about 1.5 grams per cubic centimeter to about 5.0 grams per cubic centimeter being more common. Other vales can also be used. The weight of the projectile is typically in the range of about 15 grams to about 100 grams with about 15 grams to about 50 grams being more common. Common diameters for projectile 18 are typically in a range of about 10 mm to about 40 mm with about 15 mm to about 30 mm being more common. One common TPE for the low durometer material (whether used with or without the relatively higher durometer material) is styrene-ethylene-butadiene-styrene (SEBS) base polymer, but other TPE variations or elastomers can be used as long as they posses the desired durometer.

Figure 3A:
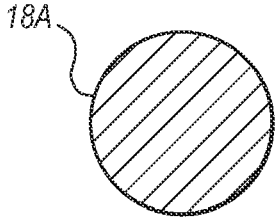
FIG. 3A is a cross sectional side view of a projectile shown in FIG. 2 having no voids.
Figure 3B:
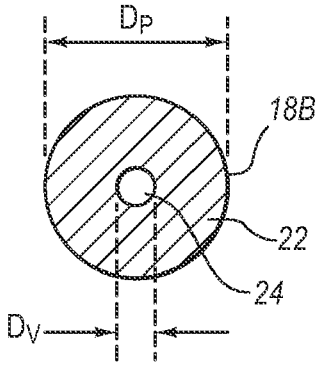
FIG. 3B is a cross sectional side view of an alternative embodiment of a projectile having a center void.
Figure 3C:
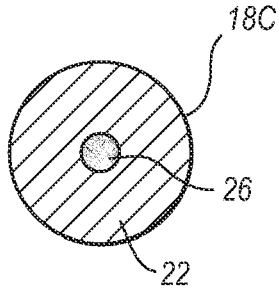
FIG. 3C is a cross sectional side view of an alternative embodiment of a projectile having a foamed core.

In a first embodiment depicted in FIG. 3A, a projectile 18A has a spherical configuration and no internal voids (other than those that may be inadvertently created during the manufacturing process). In a second embodiment depicted in FIG. 3B, a projectile 18B is shown comprising a spherical body 22 having a void 24 with a substantially spherical configuration that is located in the center of spherical body 22 and that is filled with a gas such as air. In FIG. 3B, $D_P$ is the diameter of the projectile and $D_V$ is the diameter of spherical void 24. In alternative embodiments, void 24 need not be spherical but can have alternative shapes. In a third embodiment depicted in FIG. 3C, a projectile 18C is shown comprising spherical body 22 and having a foamed core 26 comprised of a multitude of smaller voids in the center of body 22. Foamed core 26 can be created by a foaming agent such as HYDROCEROL® 861 manufactured by Clariant Corporation. One purpose of void 24 and foamed core 26 is to facilitate loading projectile 18 into sabot 16 by making it easier to compress projectile 18.

The diameter $D_P$ of projectile 18 is typically about 20 percent to about 100 percent larger than the diameter $D_C$ of casing 12 (FIG. 1) in which projectile 18 resides. Therefore, the material of which projectile 18 is made is sufficiently flexible to be deformed so as to be placed within the cylindrical chamber of casing 12 yet sufficiently resilient to rebound to its original undeformed shape after separation from casing 12. In the second and third embodiments, the maximum diameter $D_V$ of the void 24 or foamed core 26 is typically in a range of about 20 percent to about 50 percent of the diameter $D_P$ of the corresponding projectile.

Projectile 18 typically has a spherical configuration so that no specific orientation is required during loading or discharge. In alternative embodiments, however, projectile 18 can have alternative configurations such as a bullet shape or oblong configuration.

Figure 4:
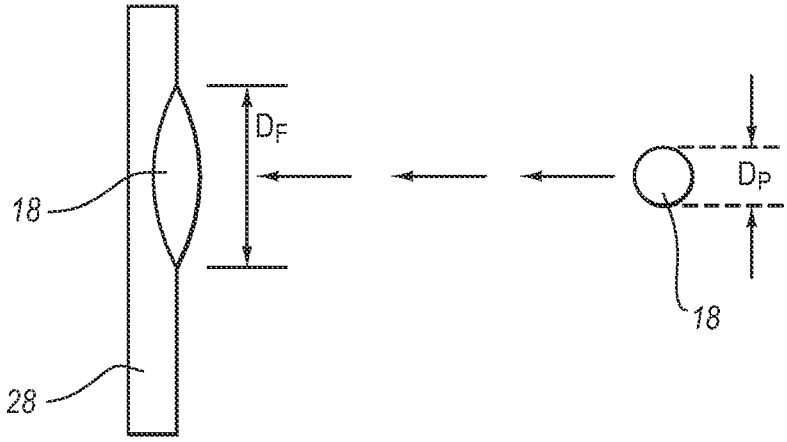
FIG. 4 is a schematic representation of the projectile shown in FIG. 2 hitting a target.

With reference to FIG. 4, when projectile 18 is discharged from cartridge 10 and impacts against a target 28, projectile 18 flattens against target 28, thus making the diameter $D_F$ of the flattened projectile 18 greater than the original diameter $D_P$ of projectile 18. This flattening effect serves to spread the force over a larger area and reduce the maximum induced pressure spike. At relatively close range, projectile 18 has high velocity and, therefore, more kinetic energy, which results in greater flattening of projectile 18 and lessening of the impact. This lessened impact prevents penetration of the target and consequent injury. At longer range, the flattening of projectile 18 is not as great due to the reduced velocity and less kinetic energy upon impact. As a result of the unique construction of the projectile of the present invention, the risk of injury at close range is greatly reduced, but projectile 18 is nevertheless accurate and effective over longer ranges. Again, due to its resilient nature, projectile 18 will typically rebound to substantially its original spherical configuration after it impacts a target.

For most applications, the desired energy level for projectile 18 upon exit from the gun barrel will be in the range of 120 to 200 joules. In applications where projectile 18 is intended to be considered "non-lethal," projectile 18 must not leave a hole deeper than 44 millimeters in calibrated ballistic clay as per current standards. In one example of the present invention, projectile 18 exits a gun barrel with an average of 166.17 joules and penetrates average calibrated ballistic clay to a depth of 41 millimeters. However, it is appreciated that projectile 18 can be used in a variety of different situations where projectile 18 may not be considered non-lethal. For example, large diameter projectiles 18 can be used for breaking down a door or for otherwise providing a large, blunt force against an inanimate object. In such cases, projectile 18 can be propelled at significantly higher levels of energy.

Returning to FIGS. 1 and 2, the remainder of cartridge 10 will now be discussed with greater detail. As previously discussed, casing 12 comprises a tubular sleeve 30 having a base 32 mounted on the end thereof. In one embodiment, casing 12 can comprise a conventional shotgun shell casing such as those used for a 4-10 gauge, 20-20 gauge, 10 gauge, 12 gauge, or other standard or specialty sized shotgun. Casing 12 can also be specially designed having a larger or smaller configuration.

Tubular sleeve 30 has an interior surface 34 that extends between a first end 36 and an opposing second end 38. Interior surface 34 bounds a substantially cylindrical chamber 40. Sleeve 30 can be comprised of plastic, metal, paper, or the like, such as those used in conventional shotgun shell casings. In one embodiment, sleeve 30 can have a length in a range between about 4 cm to about 8 cm with a diameter in a range between about 1 cm to about 4 cm. Other dimensions can also be used. Base 32 is mounted on second end 38 of sleeve 30 so as to close the opening of sleeve 30 thereat and is typically comprised of brass, steel or other suitable material. Primer 42 can comprise primers used in conventional shotgun shell casings and is centrally mounted on base 32 so as to extend therethrough. Positioned adjacent to base 32 within chamber 40 is charge 44 that is typically comprised of gun powder.

Figure 5:
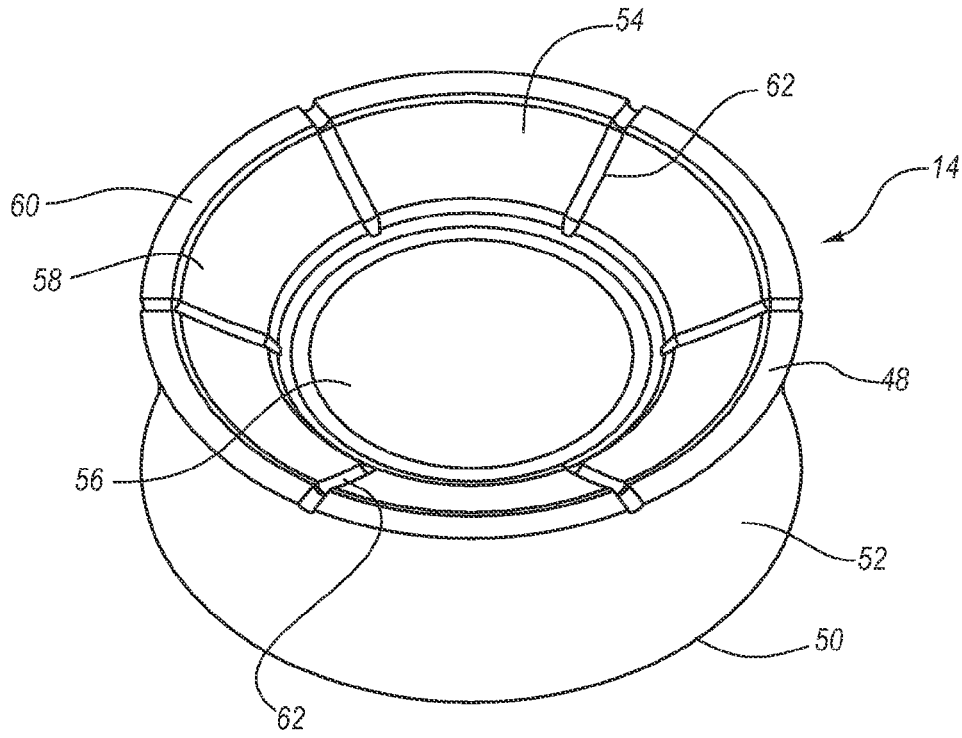
FIG. 5 is a top perspective view of a gas seal wad shown in FIG. 2.
Figure 6:
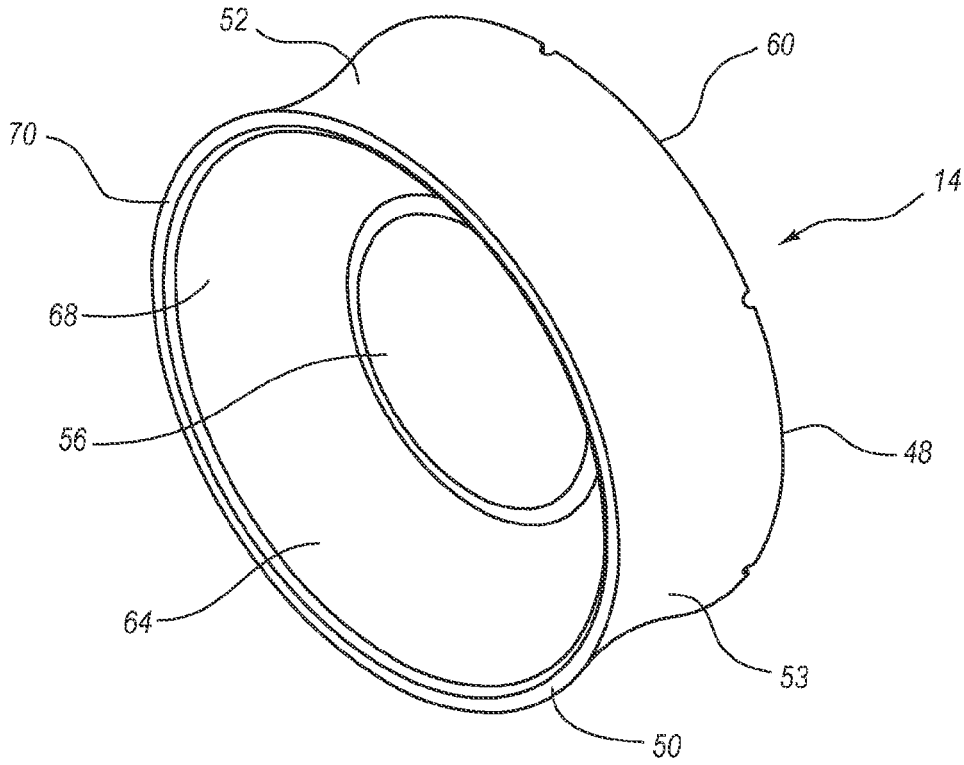
FIG. 6 is a bottom perspective view of a gas seal wad shown in FIG. 5.

During assembly of cartridge 10, gas seal wad 14 is positioned within chamber 40 of casing 12 adjacent to charge 44. Part of the function of gas seal wad 14 is to contain the expanding gas from charge 44 behind gas seal wad 14 so as to maximize the drive force on wad 14, sabot 16 and projectile 18. As depicted in FIGS. 5 and 6, gas seal wad 14 has a generally cylindrical configuration and comprises a top surface 48, an opposing bottom surface 50, and an encircling side wall 52 extending therebetween. Top surface 48 has a recessed pocket 54 formed thereon. Pocket 54 comprises a central floor 56 and a substantially frustoconical ring 58 that tapers up and away from central floor 56 to a perimeter edge 60. A plurality of radially spaced apart channels 62 are recessed on ring 58 and radially extend out from central floor 56 to perimeter edge 60. As will be discussed later in greater detail, channels 62 function as pathways for the removal of gas from within chamber 40. In alternative embodiments, it is appreciated that channels 62 can extend into or across floor 56.

As depicted in FIG. 6, bottom surface 50 also has a recessed pocket 64 formed thereon. Pocket 64 includes central floor 56, as discussed above, and a substantially frustoconical annular lip 68 that encircles floor 56 and that projects out and away from floor 56 to a perimeter edge 70. Sidewall 52 has an annular groove 53 recessed thereon that encircles gas seal wad 14 and extends between opposing perimeter edges 60 and 70. During operation, when charge 44 is discharged, the expanding gas therefrom causes annular lip 68 to radially outwardly expand so as to seal against the interior surface of the gun barrel as gas seal wad 14 travels the length of the gun barrel. This seal between wad 14 and the gun barrel helps to optimize propulsion of projectile 18. Annular groove 53 formed on sidewall 52 minimizes frictional engagement between gas seal wad 14 and the interior surface of the gun barrel. That is, as a result of annular groove 53 only annular lip 68 of gas seal wad 14 engages the interior surface of the gun barrel. Annular groove 53 also helps to increase the flexibility of annular lip 68. Gas seal wad 14 is typically made from a polymeric material but other flexible materials can also be used.

Figure 7:
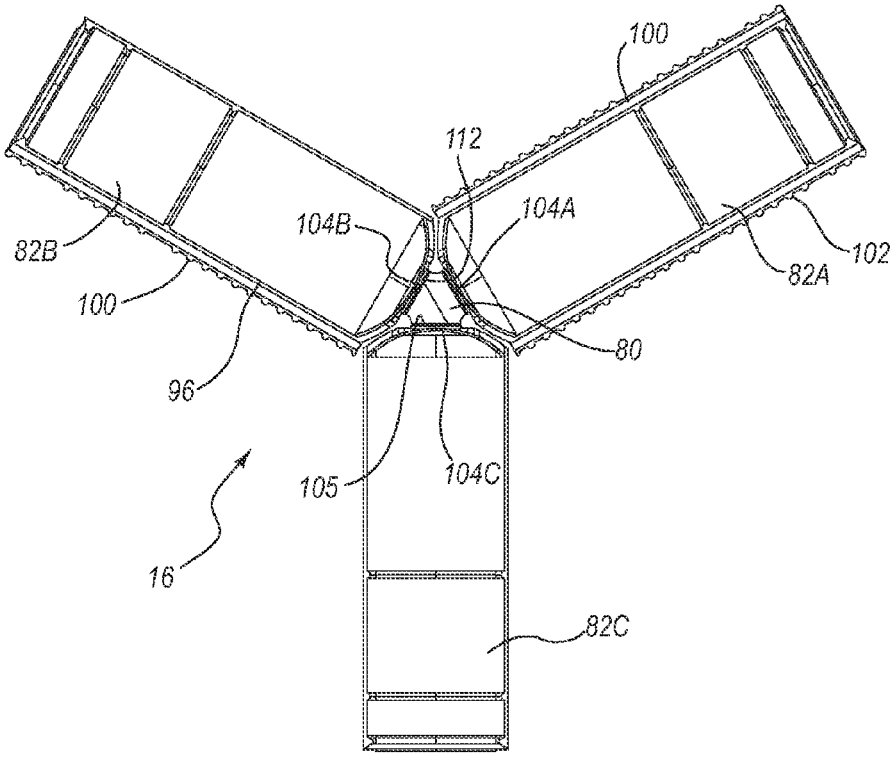
FIG. 7 is a top plan view of the sabot shown in FIG. 2 in an expanded position.
Figure 8:
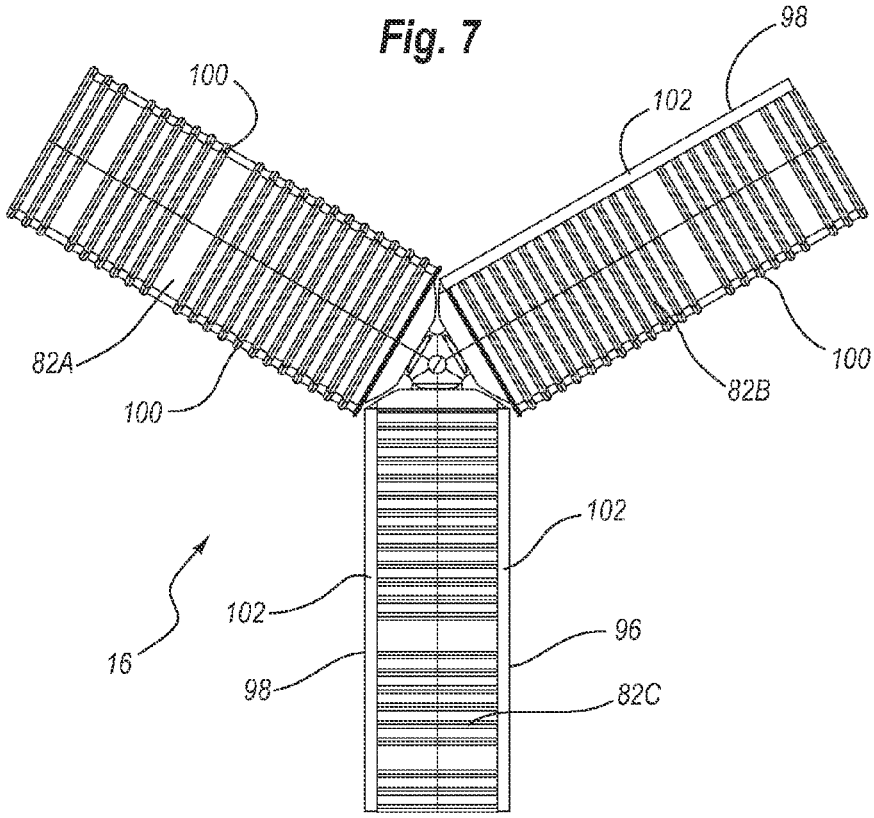
FIG. 8 is a bottom plan view of the sabot shown in FIG. 7.

Returning to FIGS. 1 and 2, positioned on top of gas seal wad 14 within chamber 40 of casing 12 is sabot 16. As depicted in FIGS. 7 and 8, sabot 16 comprises a base 80 and a plurality of petals 82 hingedly connected thereto. In the embodiment depicted, the plurality of petals 82 comprise three petals 82A, 82B, and 82C. In alternative embodiments the sabot can comprise two or four or more petals. As perhaps better depicted in FIG. 9, petal 82A comprises an elongated sidewall portion 84 and a floor portion 86 projecting therefrom. Sidewall portion 84 has an arched interior surface 88 and a complimentary arched exterior surface 90 each extending between a first end 92 and an opposing second end 94. Both of interior surface 88 and exterior surface 90 laterally extend between opposing side edges 96 and 98 that both extend along the length of sidewall portion 84. Outwardly projecting from each side edge 96 and 98 along the length thereof is a lip 100.

Floor portion 86 projects from interior surface 88 at second end 94 of sidewall portion 84. Floor portion 86 includes an interior surface 106 and an opposing exterior surface 108 that each extend between an inside edge 110 and an opposing mounting edge 112. Inside edge 110 is curved and laterally extends along interior surface 88 of sidewall portion 84 between side edges 96 and 98. Floor portion 86 inwardly projects from sidewall portion 84 so as to form an inside angle θ between interior surface 88 of sidewall portion 84 and interior surface 106 of floor portion 86 that is less than 160° and is typically in a range between about 90° to about 160°. In the depicted embodiment, floor portion 86 slopes down and away from sidewall portion 84 so that inside angle θ is more commonly in a range between about 110° and 160°. Other angles and ranges can also be used.

Petals 82B and 82C are substantially identical to petal 82A except that in contrast to having lips 100 outwardly projecting from side edges 96 and 98, petal 82B includes lip 100 projecting from side edge 96 and a complimentary recess 102 (FIG. 8) that is formed on the exterior surface of side edge 98 along the length thereof. Similarly, petal 82C does not include a lip 100 but rather includes two recesses 102 formed along the exterior surface of side edges 96 and 98.

Figure 10:
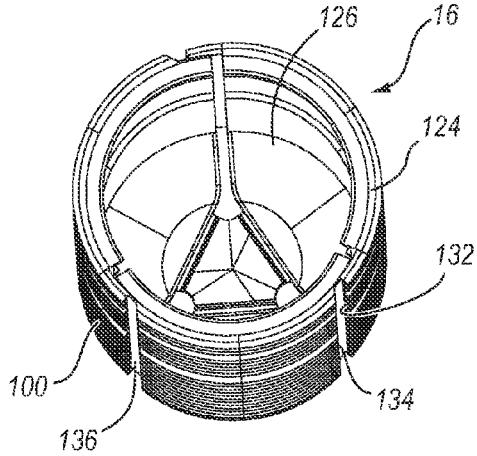
FIG. 10 is a top perspective view of the sabot shown in FIGS. 7 and 8 in a collapsed position.
Figure 11:
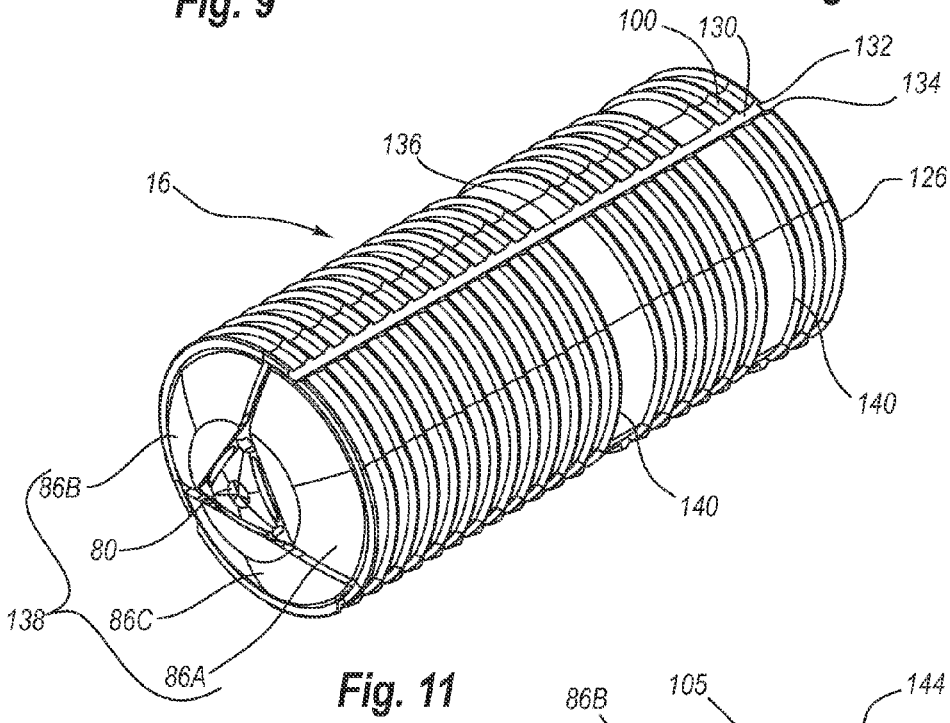
FIG. 11 is a side perspective view of the sabot shown in FIG. 10.
Figure 12:
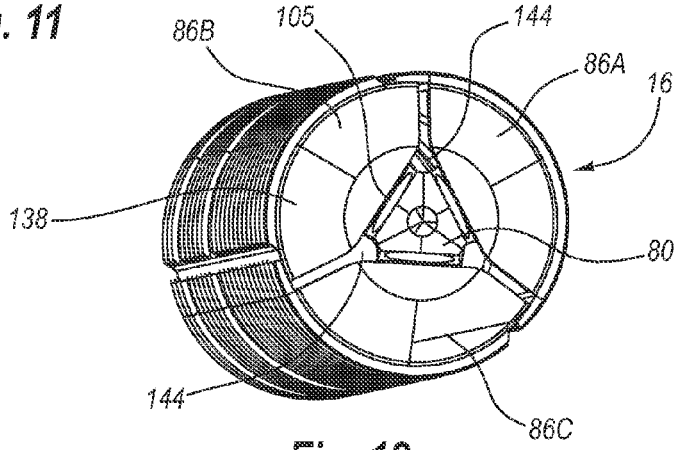
FIG. 12 is a bottom perspective view of the sabot shown in FIG. 11.

Base 80 has a substantially triangular configuration with three linear side edges 104A, 104B and 104C. Mounting edge 112 of each petal 82 is pivotably connected to a corresponding side edge 104 of base 80. In one embodiment, each mounting edge 112 is mounted to a corresponding side edge 104 of base 80 by a living hinge 105. In this embodiment, base 60 and each of petals 82 are integrally molded as a unitary member from a polymeric or other suitable material. As a result of the hinged connection between base 80 and the petals 82, sabot 16 can be selectively moved between a collapsed position as shown in FIGS. 10-12 and an expanded position as shown in FIGS. 7 and 8. In an alternative design, each mounting edge 112 can be connected to a corresponding side edge 104 by a spot or thin wall connection that will tear or otherwise fail after being bent only a few times such as, for example, less than 10 time or less than 5 times. In this embodiment, one or more of the connections between each mounting edge 112 and a corresponding side edge 104 can be designed to fail as the sabot 16 is discharged from casing 12.

In the collapsed position as shown in FIGS. 10 and 11, each of petals 82 combine so that the sidewall portions 84 form a substantially cylindrical sidewall 124 that bounds a compartment 126. As petals 82 are moved into the collapsed position, each lip 100 formed on a side edge of a petal 82 is received within or overlaps a recess 102 formed on a side edge of an adjacent petal 82. As a result of the overlapping between the lips 100 and recesses 102, sidewall 124 continuously encircles compartment 126 in that there are no exposed openings extending through sidewall 124 when sabot 16 is in the collapsed position.

As previously discussed, projectile 18 remains within compartment 126 of sabot 16 as projectile 18 and sabot 16 travel along the length of the gun barrel. Due to the flexible nature of projectile 18, projectile 18 seeks to compress along the axis of the gun barrel and radially outwardly expand orthogonal thereto as projectile 18 accelerates within the gun barrel. Due to this radial expansion, if there are any openings formed through sidewall 124 of sabot 16, projectile 18 will expand out through the opening and rub along the interior surface of the gun barrel. Engagement between projectile 18 and the interior surface of the gun barrel causes a portion of projectile 18 to rub off onto the interior surface of the gun barrel which in turn gums up the interior surface of the gun barrel. Such deposit of projectile 18 on the interior surface of the gun barrel either prevents or hampers further discharge of projectiles out of the gun barrel until the gun barrel is cleaned.

As also depicted in FIGS. 10-12, when petals 82 are in the collapsed position so that each lip 100 is received within a corresponding recess 102, a gap 130 is formed between a terminal end face 132 each lip 100 and an inside edge 134 of the correspondence recess 102. This gap 130 forms an elongated channel 136 that extends the entire length of sidewall 124. As will be discussed below in greater detail, channels 136 are used in the removal of gas from casing 12 during the loading of projectile 18 within sabot 16. In contrast to having elongated channels 136 that are formed at the intersection of lips 100 and recesses 102, elongated recessed channels 136 can be formed along the length of sidewall portions 84 at any lateral location between opposing side edges 96 and 98.

As depicted in FIGS. 11 and 12, base 80 and floor portions 86A, 86B, and 86C combine to form a floor 138 having a substantially circular, dome shaped configuration that outwardly projects away from compartment 126. Floor portions 86A-C are formed so that openings 144 are formed between adjacent petals 86 and that extend through floor 138 so as to communicate with compartment 126. Again, as will be discussed below with greater detail, openings 144 are used in the removal of gas from casing 12 during the loading of projectile 18 within sabot 16.

Floor 138 has a configuration substantially complementary to recessed pocket 54 on top surface 48 of gas seal wad 14 (FIG. 5). When disposed within casing 12, floor 138 of sabot 16 is received within pocket 54 of gas seal wad 14. As a result of this complementary nesting between floor 138 and pocket 54, frustoconical ring 58 of gas seal wad 14 provides lateral support for floor 138 and the living hinges 105 formed thereon. That is, as discussed above, during acceleration of projectile 18 within the gun barrel, projectile 18 seeks to radially, outwardly expand. If left unchecked, such expansion can cause expansion of floor 138 of sabot 16 which in turn can cause stretching and failure of the living hinges 105 and thus separation of petals 82. Such deterioration of sabot 16 within the gun barrel can have a negative impact on the trajectory of projectile 18. To prevent unwanted expansion of floor 138, gas seal wad 14 is provided with frustoconical ring 58 which encircles and laterally supports floor 138 and thus prevents or limits unwanted expansion of floor 138.

Sabot 16 is originally molded in the expanded position as depicted in FIGS. 7 and 8 and then manually moved to the collapsed position for loading into casing 12. As sabot 16 and projectile 18 exit from the gun barrel, sabot 16 resiliently expands back toward the expanded position due to energy stored in the living hinges 105. This expansion of sabot 16 is further assisted by the unrestrained, radial expansion of projectile 18 and as it resiliently returns to its original, uncompressed state. As soon as petals 82 start to expand, the air catches petals 82 causing sabot 16 to instantly move to its expanded position which in turn slows sabot 16 and causes separation between sabot 16 and projectile 18.

The above configuration for sabot 16 has a number of advantages over conventional sabots. For example, because living hinges 105 about which petals 82A-C pivot are formed on floor 138. The entire length of petals 82A-C are able to fold away from projectile 18 to facilitate ease in separation between sabot 16 and projectile 18. This is in contrast to many conventional sabots where the petals only fold back at the upper end of the sabot and a significant portion of the projectile remains with the compartment of the sabot. Furthermore, unlike conventional sabots where open slots are formed on the sidewall of the sabot, the sidewall of sabot 16 is closed when in the collapsed position so that projectile 18 cannot expand out through the sidewall. In addition, unlike conventional sabots, sabot 16 enables gas to pass through the floor of the sabot and to travel up the full length of the exterior surface of the sabot so that gas can be removed from the compartment of sabot 16 during loading of projectile 18.

As also depicted in FIGS. 10-12, a plurality of longitudinally spaced apart ribs 140 radially outwardly project from the exterior surface 90 of each petal 82 and laterally extend between opposing side edges 96 and 98. Ribs 140 can serve a variety of different functions. For example, as previously discussed, as sabot 16 and projectile 18 travel down the length of the gun barrel, expanding projectile 18 pushes the sidewall of sabot 16 against the interior surface of the gun barrel. By having ribs 140, only the spaced apart ribs 140 ride against the interior surface of the gun barrel. Ribs 140 thus decrease the frictional engagement between sabot 16 and the interior surface of the gun barrel. Ribs 140 can also assist in cleaning the interior surface of the gun barrel. That is, as sabot 16 travels the length of the gun barrel, ribs 140 scrap against the interior surface of the gun barrel which scraping removes deposits and collects them between adjacent ribs 140.

As a further function, most gun barrels have rifling which comprises small, helically grooves that extend the length of the gun barrel. The rifling causes the projectile to spin as it travels the length of the gun barrel. Spinning of the projectile improves the consistency and accuracy of the projectile trajectory. As ribs 140 engage the rifling of the gun barrel, sabot 16 rotates within the gun barrel which in turn causes the rotation of projectile 18. Outwardly projecting ribs 140 can more easily engage the rifling than a sabot with a smooth exterior surface. As such, ribs 140 improve spin and trajectory of projectile 18. In alternative embodiments it is appreciated that ribs 140 need not laterally extend along petals 82 but can alternatively or in combination extend longitudinally along the length of petals 82 or at any desired angle. Furthermore, ribs 140 can be replaced with other forms of projections such as domed or other shaped points that are spaced apart and formed on the exterior surface of each petal 82.

Figure 9:
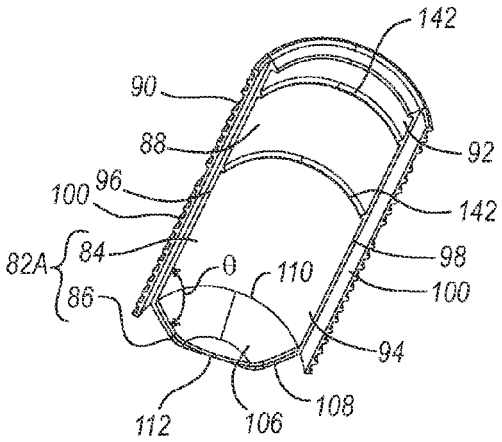
FIG. 9 is a perspective view of one petal of the sabot shown in FIGS. 7 and 8.

As sabot 16 travels along the length of the gun barrel, friction between the gun barrel and sabot 16 causes sabot 16 to decelerate within the gun barrel. As sabot 16 decelerates, projectile 18 within sabot 16 tries to separate from sabot 16 while it is still within the gun barrel. Early separation of projectile 18 from sabot 16 within the gun barrel can cause projectile 18 to rube against the interior surface of the gun barrel as discussed above and can also significantly affect the trajectory of projectile 18. Accordingly, in one embodiment of the present invention, means are provided on the interior surface of petals 82A-C for engaging projectile 18 when projectile 18 is disposed within chamber 126 of sabot 16. By way of example and not by limitation, as depicted in FIG. 9, ribs 142 project from interior surface 88 of each petal 82. Ribs 142 are longitudinally spaced apart and extend laterally between opposing side edges 96 and 98. Ribs 142 engage projectile 18 and prevent unwanted separation between sabot 16 and projectile 18 within the gun barrel.

In alternative embodiments of the means for engaging projectile 18, it is again appreciated that ribs 142 can be replaced with a variety of different shapes and layouts of projections that extend from interior surface 88 of each petal 82 so as to engage projectile 18. For example, ribs 142 can be replaced with spikes or a variety of other circular, polygonal, or irregular projections extending from interior surface 88 of each petal 82. Furthermore, to help ensure that projectile 18 spins concurrently with sabot 16 within the gun barrel and does not merely slip within sabot 16, ribs or other forms of projections can be formed on interior surface 88 of petals 82 that extend longitudinally along the length of petals 82. Other shapes and configurations of projections can also be used.

Sabot 16 is typically made of a material that is flexible, strong, and has a low coefficient of friction so as to not leave residue within the gun barrel. Preferred materials include polymeric materials such as polyethylene or nylon, although other materials can also be used.

Figure 13:
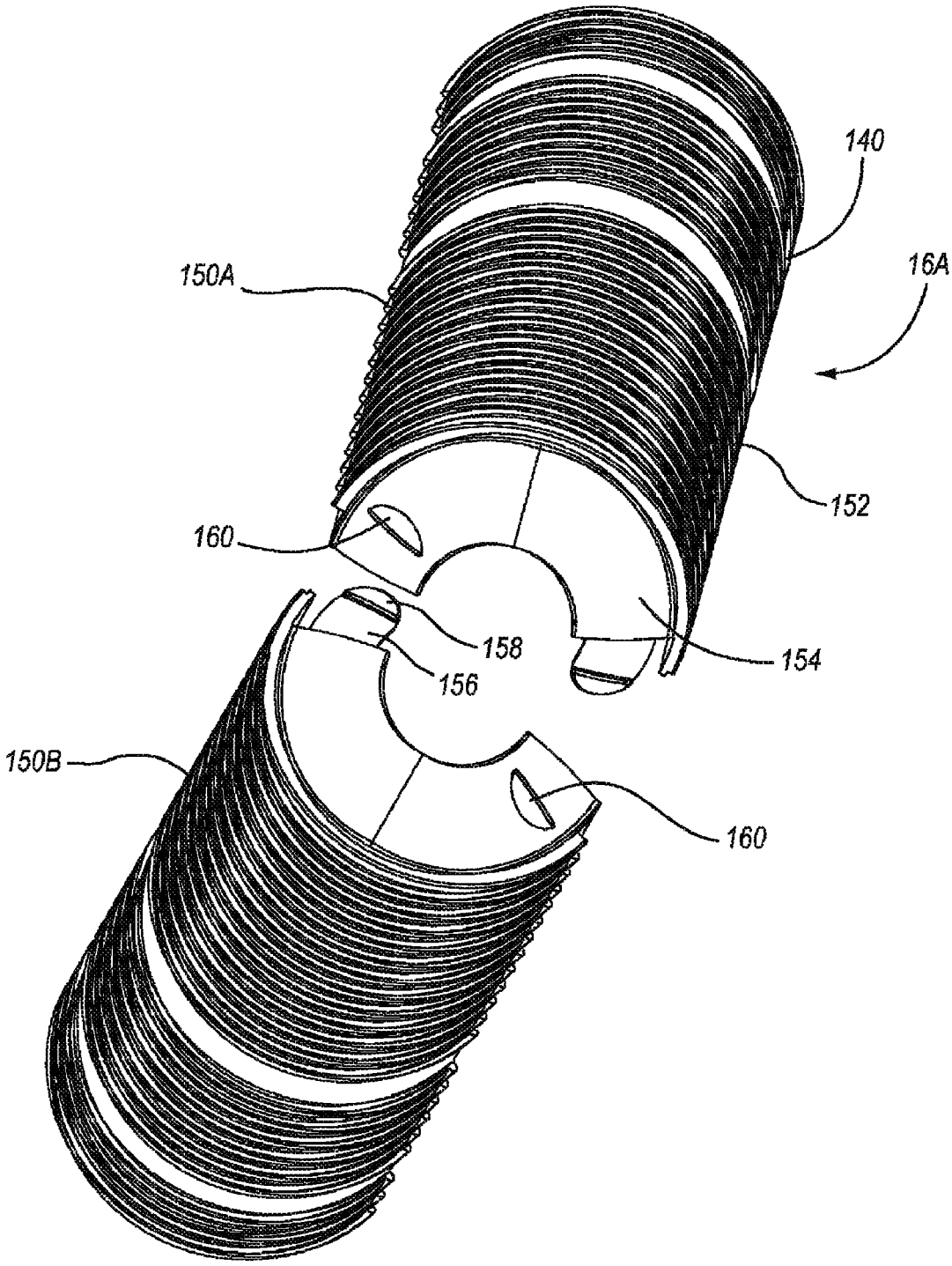
FIG. 13 is a bottom perspective view of an alternative embodiment of a sabot having only two petals.

Depicted in FIG. 13 is an alternative embodiment of a sabot 16A incorporating features of the present invention. Like elements between sabots 16 and 16A are identified by like reference characters. In contrast to sabot 16 which has three distinct petals 82A-C, sabot 16A comprises only two petals 150A and 150B. Each petal 150 includes a sidewall portion 152 and a floor portions 154. Sidewall portions 152 are similar to sidewall portions 84 (FIG. 9) except that sidewall portions 152 have a substantially semicircular configuration in that there are only two petals 150A and 150B. Furthermore, floor portions 154 can have a configuration similar to floor portions 86 (FIG. 9) which can be directly connected together by a living hinge or which can both connect on opposing sides of a base by a living hinge. However, in contrast to sabot 16 which is formed as an integral member, sabot 16A is made from two separately formed petals 150A and 150B. Each floor portion 154 has a tab 156 projecting therefrom with a catch 158 formed on the end thereof. A notch 160 is also formed on the opposing side of each floor portion 154. When petals 152A-B are coupled together, each catch 158 is received within a corresponding notch 160 on the adjacent petal to help secure and align the coupling between petals 152A-B. As sabot 16A exits from the gun barrel, petals 150A and 150B can both pivotably separate at floor portions 154 and can also physically separate to help release projectile 18 from within sabot 16A. The above discussion with regard to ribs 140, ribs 142, lips 100 and recesses 102 and the alternatives thereof are also applicable to sabot 16A.

Figure 14:
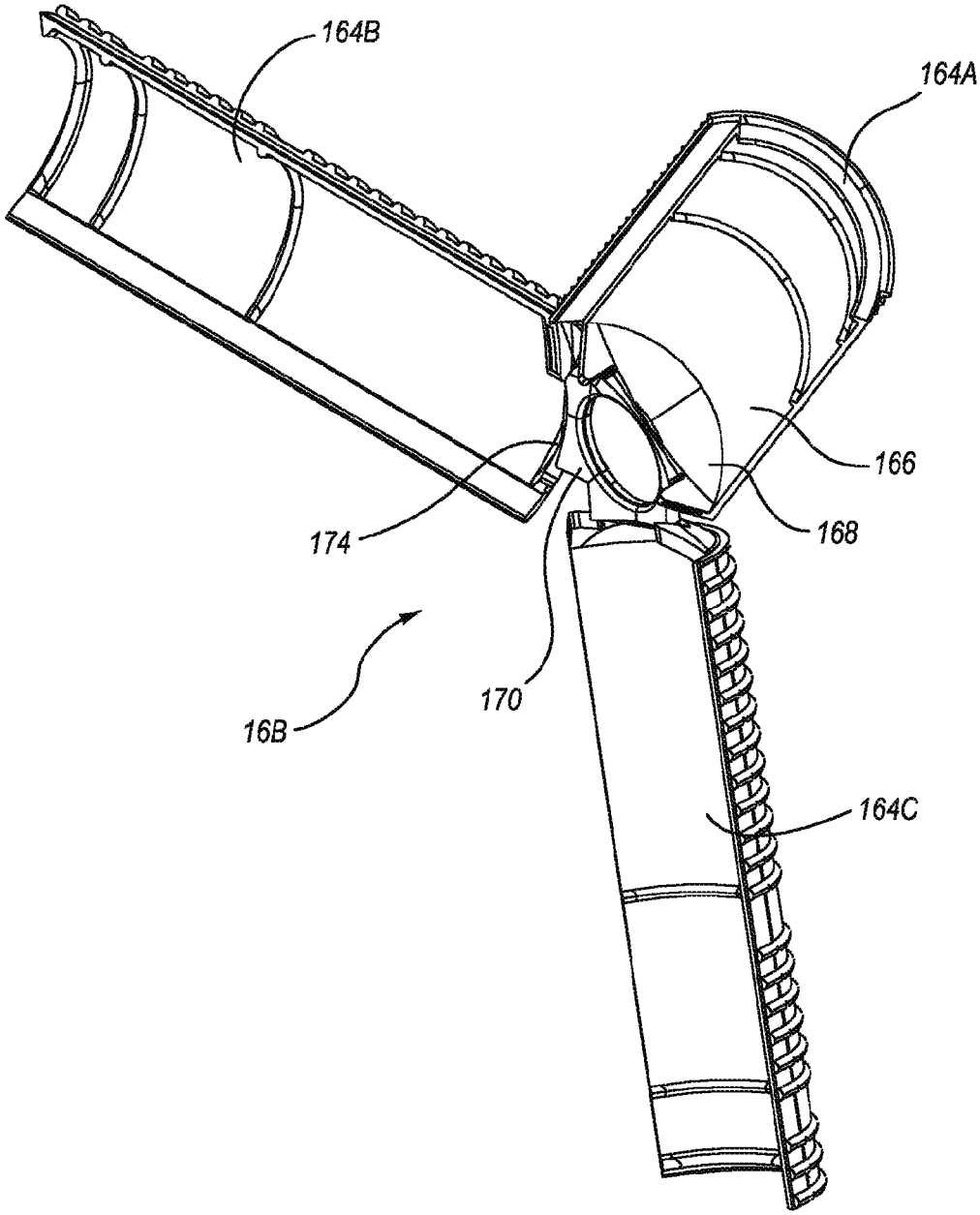
FIG. 14 is a perspective view of an alternative embodiment of a sabot having three petals.
Figure 15:
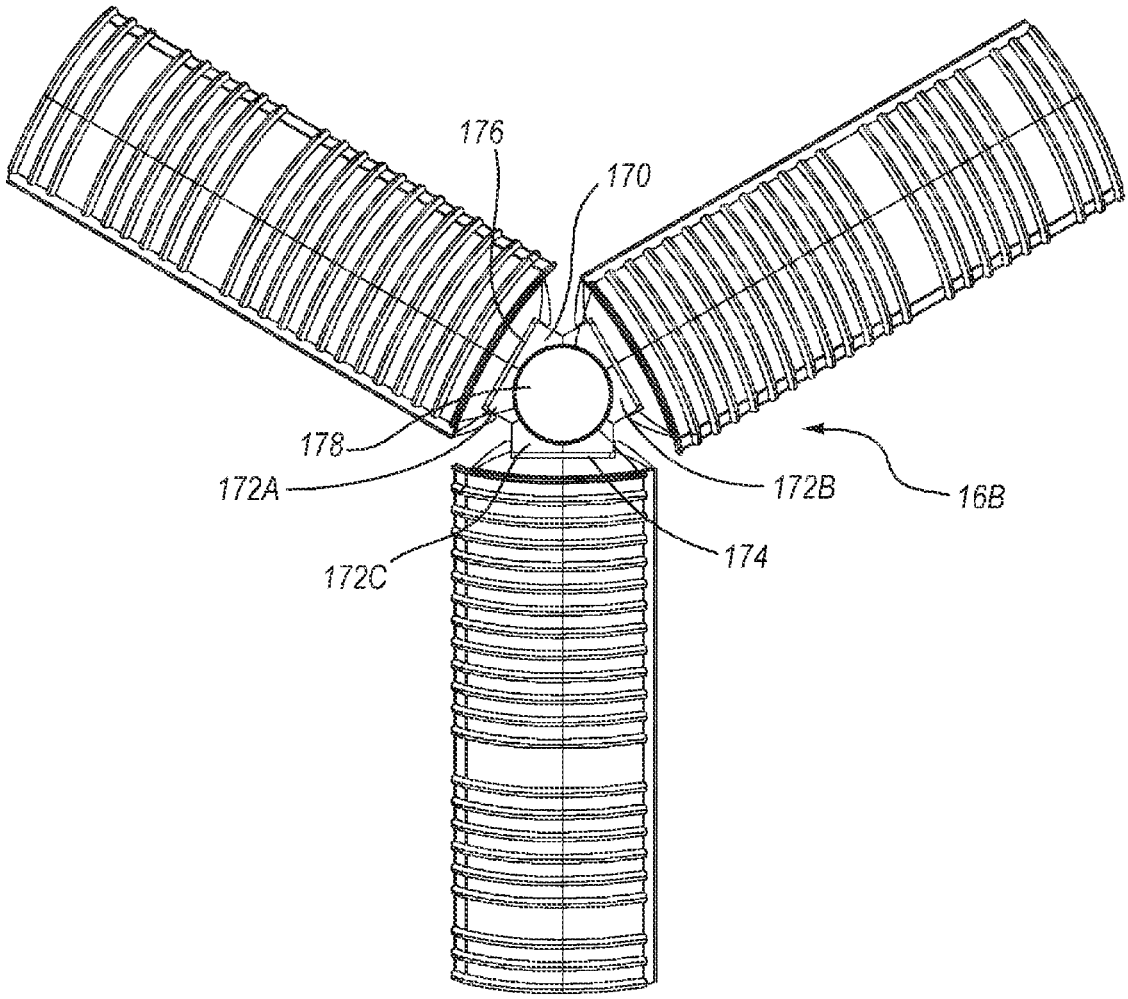
FIG. 15 is a bottom perspective view of the sabot shown in FIG. 14.

Turning to FIGS. 14 and 15 is another alternative embodiment of a sabot 16B incorporating features of the present invention. Similar to sabot 16, sabot 16B includes three petals 164A-C wherein each petal 164 includes a sidewall portion 166 and a floor portion 168 that inwardly projects from the second end of sidewall portion 166. This embodiment, however, includes an enlarged base 170 that includes three tabs 172A-C that are received within corresponding notches 174 formed on each floor portion 168. Each tab 172 is connected to a corresponding floor portion 168 by a living hinge 176. In contracts to having openings 144 which are formed between floor portions 86 (FIG. 12), base 170 has an enlarged central opening 178 extending therethrough. Again, other elements as previously discussed with regard to sabot 16 are also relevant to sabot 16B. In still other embodiments, it is appreciated that sabots of the present invention can include four or more petals.

Figure 16:
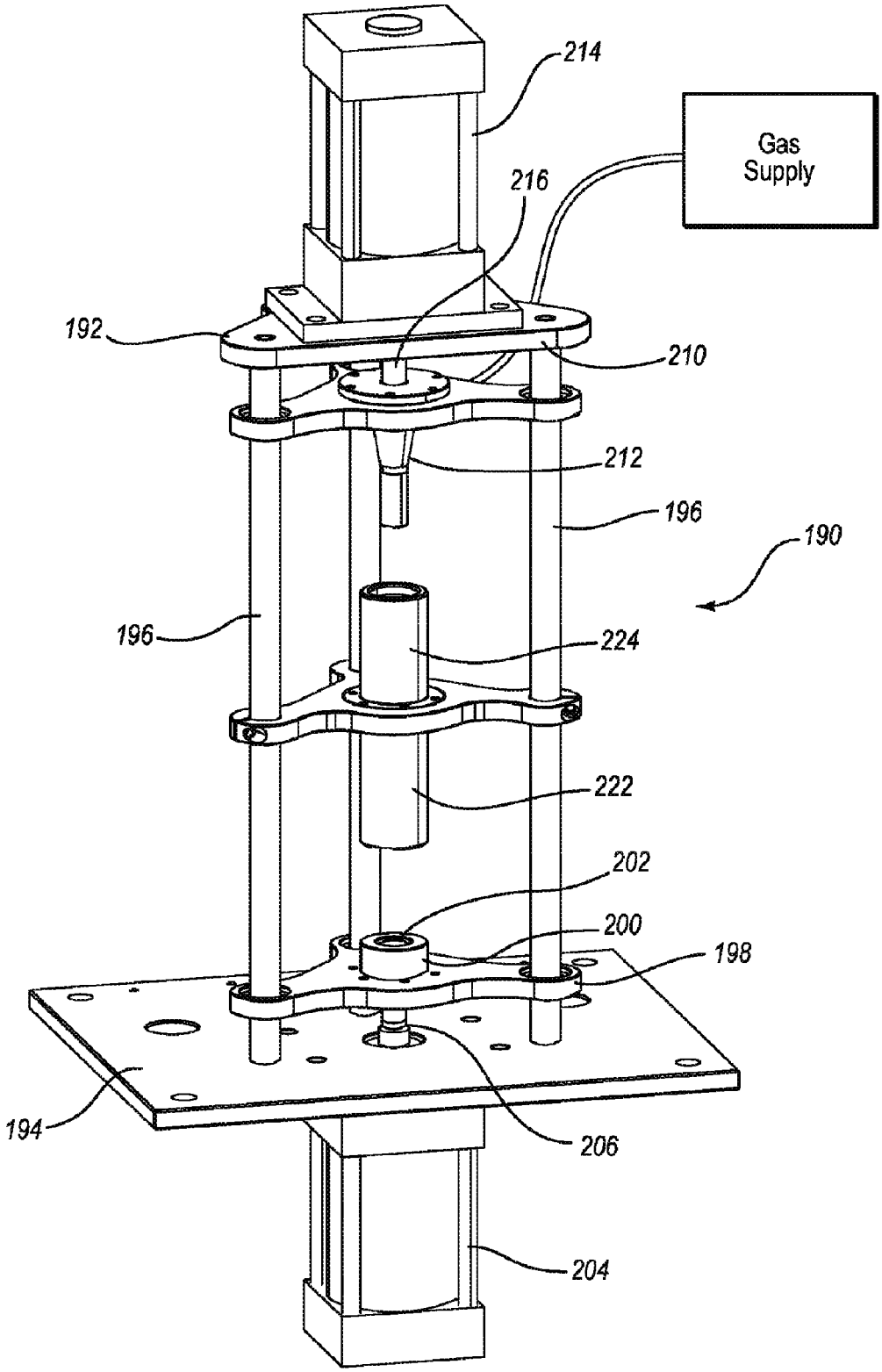
FIG. 16 is a perspective view of a loading system used in the assembly of the cartridge shown in FIG. 1.

Depicted in FIG. 16 is one embodiment of a loading system 190 for use in positioning projectile 18 within sabot 16 when sabot 16 is disposed within casing 12. In general, loading system 190 comprises an upper frame 192, a lower frame 194, and three spaced apart guide rails 196 extending therebetween. A lower plate 198 is slidably mounted on guide rails 196 adjacent to lower frame 194. A stand 200 is mounted on lower plate 198 and a socket 202 is formed on the top surface of stand 200. Socket 202 is configured to receive base 32 of casing 12 as depicted in FIG. 2. Means are provided for selectively raising and lowering stand 200 along guide rails 196. By way of example and not by limitation, a pneumatic cylinder 204 is provided with a shaft 206 that can selectively raise and lower the lower plate 198 with stand 200 thereon. In alternative examples of the means, pneumatic cylinder 204 can be replaced by a hydraulic jack, mechanical jack, or any other conventional lifting system known in the art.

An upper plate 210 is slidably mounted on guide rails 196 adjacent to upper frame 192. A plunger 212 is mounted on upper plate 210 and downwardly projects therefrom. Again, means are provided for selectively raising and lower plunger 212 along guide rails 196. One example of such means includes pneumatic cylinder 214 having a shaft 216 that can selectively raise and lower upper plate 210 with plunger 212 mounted thereon. Alternative examples for pneumatic cylinder 204 are also applicable to pneumatic cylinder 214.

Figure 17:
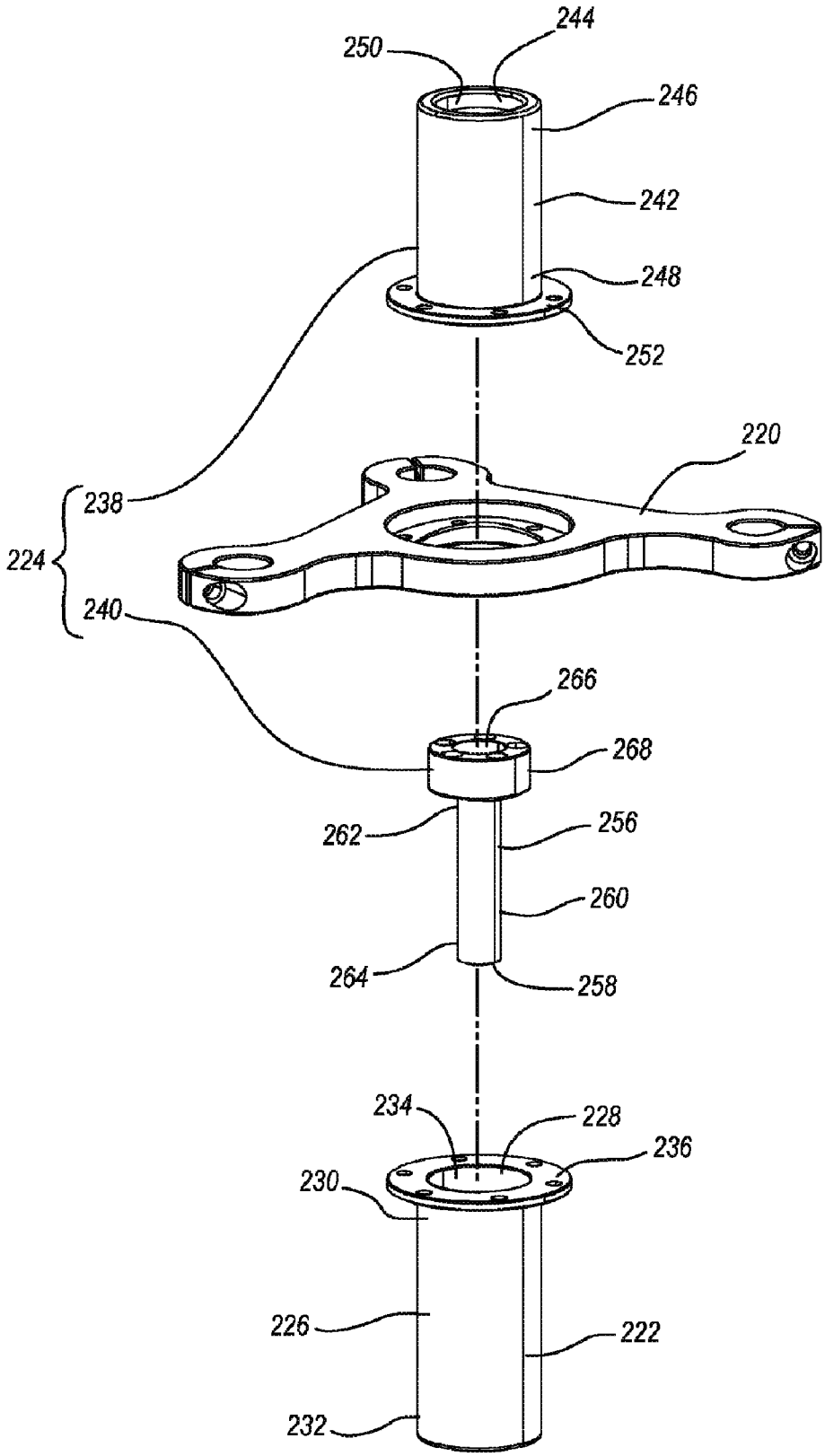
FIG. 17 is an exploded perspective view of a portion of the loading system shown in FIG. 16.
Figure 18:
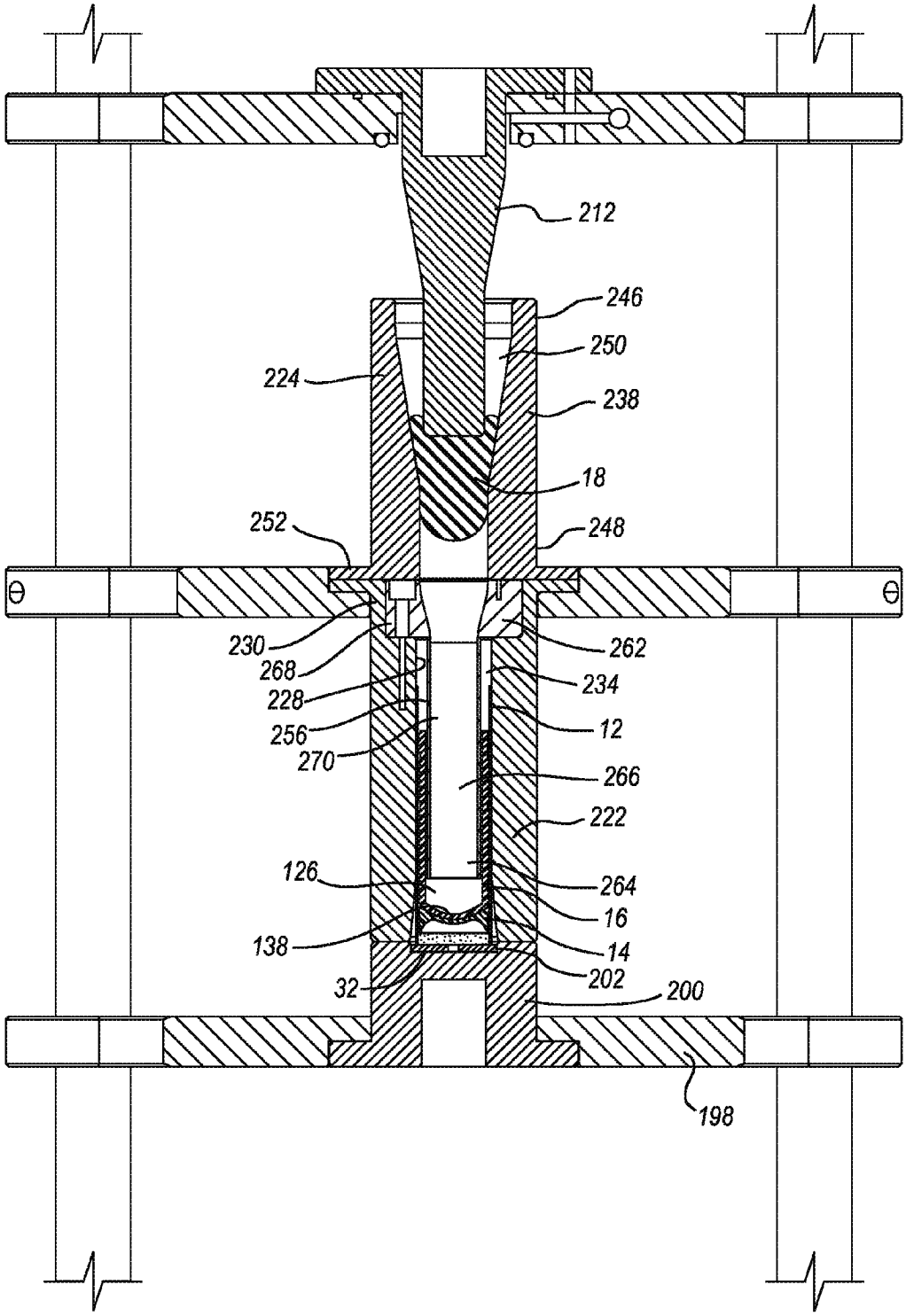
FIG. 18 is a cross sectional view of a portion of the loading system shown in FIG. 16 having the casing and sabot positioned within the loading system and the projectile being advanced within the loading system.
Figure 22:
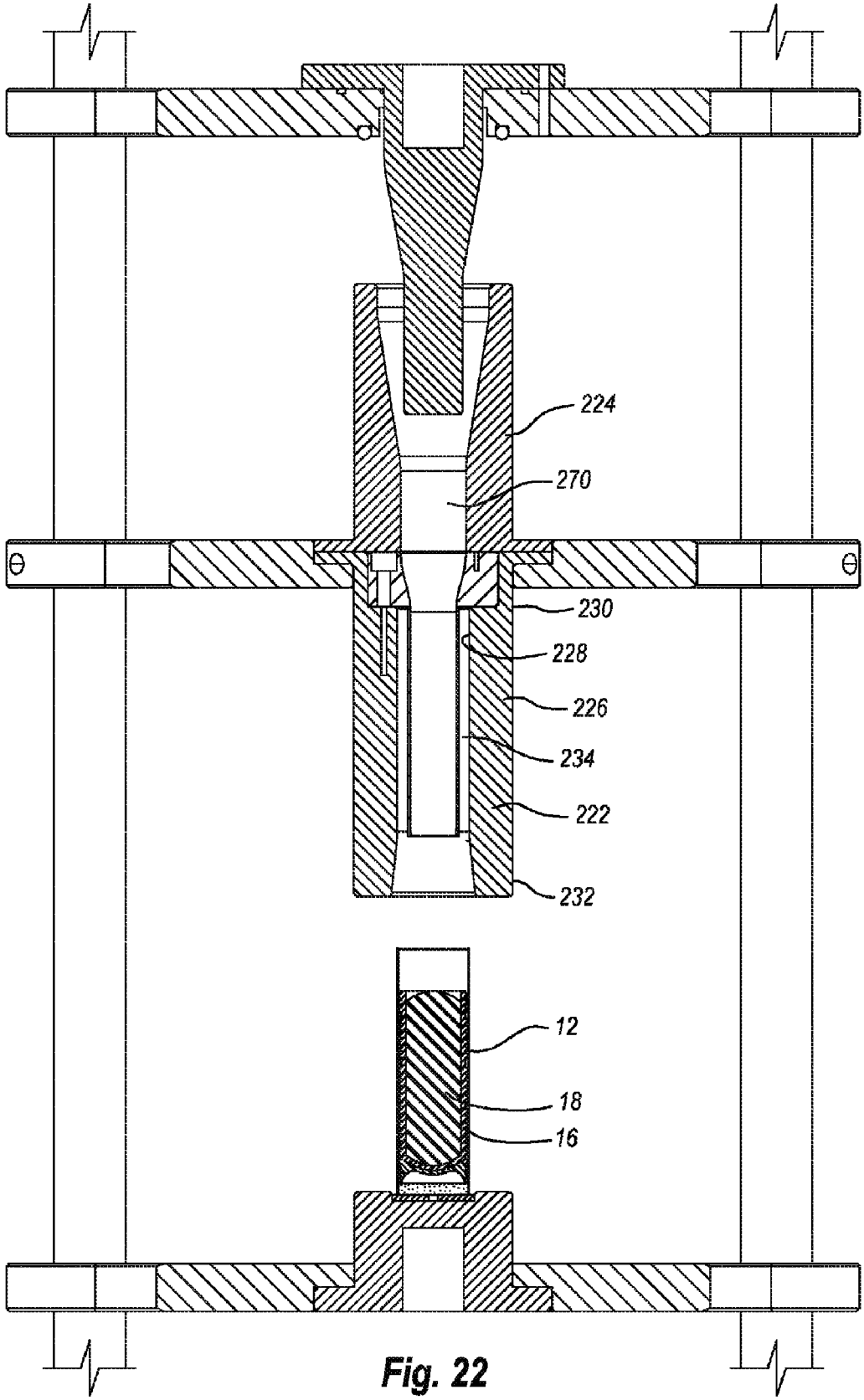
FIG. 22 is a cross sectional side view of the loading system shown in FIG. 21 wherein the projectile is fully loaded within the sabot.

Loading system 190 further includes a central plate 220 that is fixedly secured to guide rails 196 between upper plate 210 and lower plate 198. Centrally mounted on central plate 220 is a support housing 222 and a delivery tube 224. As depicted in FIGS. 17 and 22, support housing 222 comprises a tubular body 226 having an interior surface 228 extending between a first end 230 and an opposing second end 232. Interior surface 228 bounds a cavity 234 that longitudinally extends through body 226. As depicted in FIG. 18, cavity 234 has a substantially cylindrical configuration that is substantially complimentary to the exterior surface of casing 12. As a result, casing 12 can be received within cavity 234 so that casing 12 is laterally supported by interior surface 228 of support housing 222. Cavity 234 is outwardly tapered at second end 232 to help facilitate alignment and entry of casing 12 within cavity 234. Returning to FIG. 17, an annular flange 236 encircles and radially outwardly projects from first end 230 of body 226. Flange 236 is used to secure support housing 222 to central plate 220 using conventional bolts or other types of fasteners.

As shown in FIG. 17, delivery tube 224 comprises an inlet tube 238 and a dispensing tube 240. Inlet tube 238 comprises a tubular body 242 having an interior surface 244 extending between a first end 246 and an opposing second end 248. Interior surface 244 bounds a channel 250 that longitudinally extends through body 242. As illustrated in FIG. 18, channel 250 constricts as it extends from first end 246 to second end 248. Channel 250 typically has a diameter at first end 246 that is sufficiently large to enable projectile 18 to be easily, manually inserted into channel 250 at first end 246. As such, channel 250 typically has a diameter at first end 246 that is either large than, equal to, or only slightly smaller than the diameter of projectile 18. A flange 252 encircles and radially outwardly projects from body 242 at second end 248. Flange 252 is used to secure inlet tube 238 to central plate 220 using conventional methods such as bolts or other types of fasteners.

Returning to FIG. 17, dispensing tube 240 includes a tubular stem 256 having an interior surface 258 and an exterior surface 260 each extending between a first end 262 and an opposing second end 264. Interior surface 258 also bounds a channel 266 that longitudinally extends through stem 256. As depicted in FIG. 18, channel 266 constricts at first end 262 but then has a substantially constant diameter along second end 264. A flange 268 encircles and radially projects from first end 262 of stem 256. Flange 268 is seated within a counter sunk recess formed at first end 230 of support housing 222 so that stem 256 is received within cavity 234 of support housing 222.

In the assembled configuration, channel 250 of inlet tube 238 couples with channel 266 of dispensing tube 240 so as to form a continuous channel 270 that extends from first end 246 of delivery tube 224 to second end 264 of delivery tube 224. During use projectile 18 can be passed down through continuous channel 270 for delivery of projectile 18 into cavity 234 of support housing 222. As perhaps best illustrated in FIG. 22, channel 270 tapers down in spaced apart sections. Although channel 270 can be formed having a continuous, gradual taper between opposing ends of delivery tube 224, it has been found that by staggering the tapered sections along channel 270, less energy is needed for constricting and passing projectile 18 down channel 270.

Figure 19:
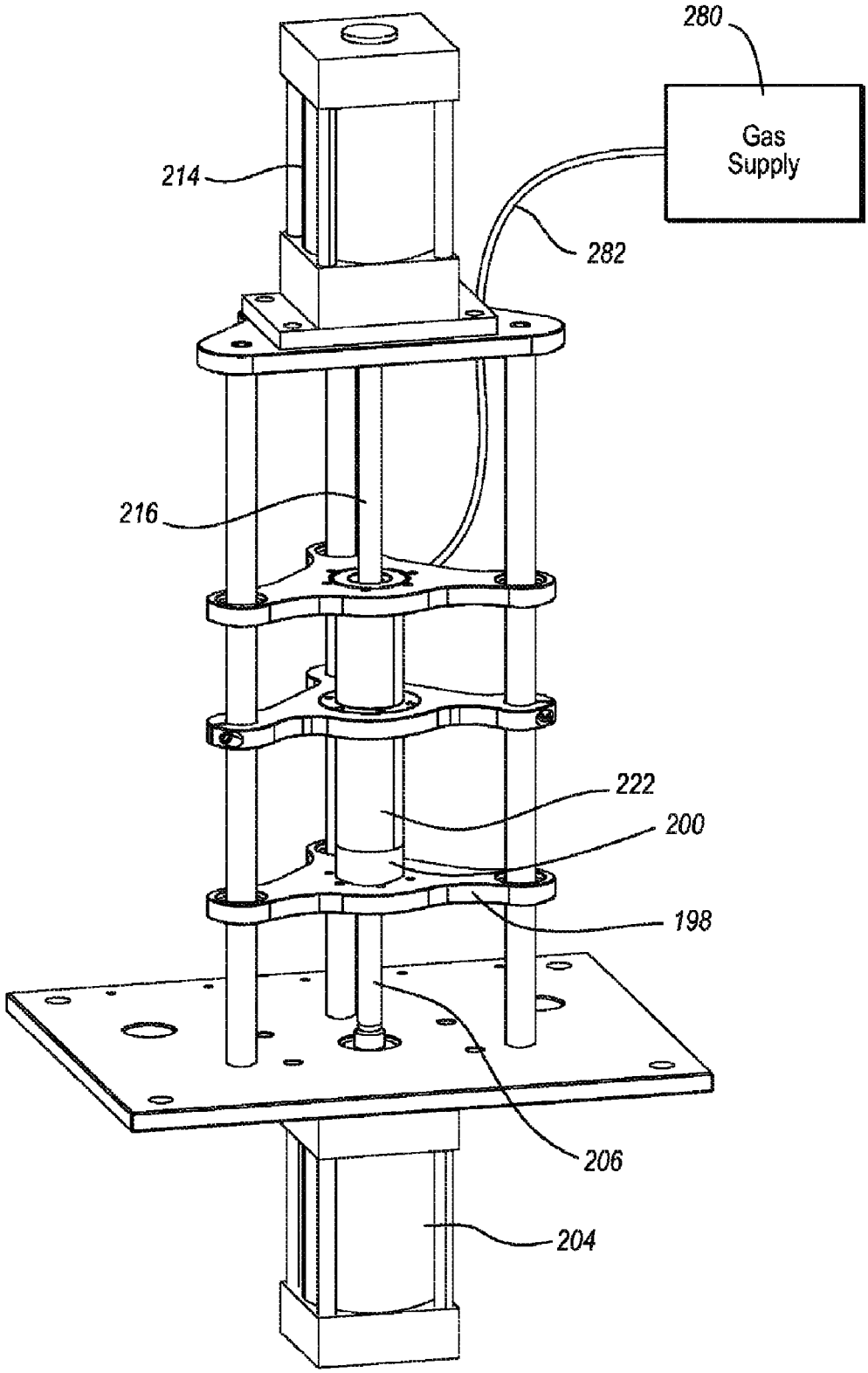
FIG. 19 is a perspective view of the loading system shown in FIG. 16 in a closed position.

To facilitate loading of projectile 18, gas seal wad 14 and sabot 16 are initially positioned within chamber 40 of cartridge 10. Next, base 32 of the assembled casing 12 is seated within socket 202 of stand 200 of loading assembly 190. As shown in FIGS. 18 and 19, pneumatic cylinder 204 is then used to elevate lower plate 198 and stand 200 so that casing 12, gas seal wad 14, and sabot 16 are received within cavity 234 of support housing 222. As casing 12 is raised into cavity 234, stem 256 of delivery tube 224 is received within compartment 126 of sabot 16. In the depicted embodiment, tubular stem 256 is configured so as to spaced a distance above floor 138 of sabot 16.

Next, to facilitate loading of projectile 18, projectile 18 is dusted with a dry powder lubricant such as graphite, polytetrafluoroethylene (which is sold under the trademark TEFLON), or other conventional dry lubricants. In one embodiment, the dry lubricant comprises a combination of graphite and TEFLON powders. Projectile 18 is then positioned within channel 270 at first end 246 of delivery tube 224.

Figure 20:
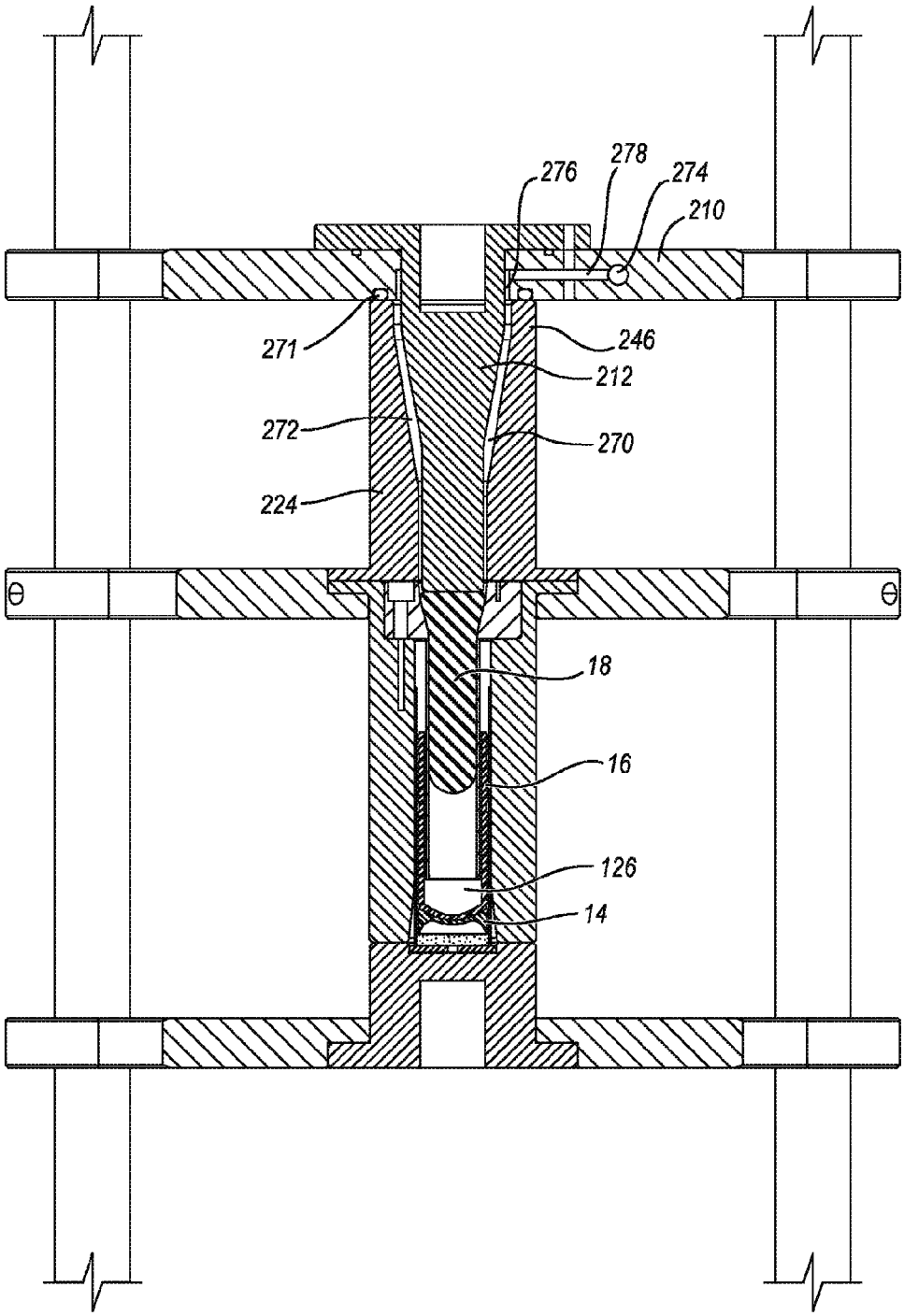
FIG. 20 is a cross sectional side view of the loading system shown in FIG. 18 wherein the plunger is fully advanced within the loading system.

As depicted in FIGS. 19 and 20, once projectile 18 is positioned, pneumatic cylinder 214 is used to progressively lower plunger 212 into channel 270. As plunger 212 is progressively lowered, plunger 212 pushes projectile 18 down the length of channel 270. In so doing, because channel 270 constricts, projectile 18 is radially inwardly compressed and thus elongated within channel 270. As a result of being compressed within channel 270, an air tight seal is formed between projectile 18 and the interior surface of channel 270. Plunger 212 continues to descend until upper plate 210 is seated against first end 246 of delivery tube 224. In the embodiment depicted, an annular seal 271 is positioned between upper plate 210 and delivery tube 224 so as to form a substantially air tight seal therebetween.

In one embodiment of the present invention means are provided for at least substantially sealing the first end of delivery tube 224 closed after projectile 18 is positioned within channel 270. One example is such means comprises upper plate 210 in conjunction with annular seal 217. In alternative embodiments, plunger 212 is not required so that upper plate 210 can be replaced with any type of stop, plug, or cover that will close off the first end of delivery tube 224.

Plunger 212 is designed having configuration that is generally complementary to the interior surface of delivery tube 224 but is sized slightly smaller than the interior surface of delivery tube 224 so that when plunger 212 is fully received within delivery tube 224, an annular gap 272 is formed between the interior surface of delivery tube 224 and the exterior surface of plunger 212 along the length of plunger 212. Gap 272 allows a gas to pass therebetween.

As shown in FIG. 20 upper plate 210 is shown having an inlet 274 formed on the exterior surface of upper plate 210, an outlet 276 formed adjacent to plunger 212 so as to communicate with gap 272, and a passage 278 that extends therebetween. As shown in FIG. 19, a gas supply 280 is coupled with inlet 274 by a tube 282. Gas supply 280 is configured to supply a pressurized stream of gas and can comprise a compressor, a container containing pressured gas, or other conventional systems used for delivering a pressured gas. Gas supply 280 can typically provide a pressured gas at a pressure of at least 100 psi (7 kg/cm$^2$) and typically 150 psi (10.5 kg/cm$^2$) or higher. Other pressures can also be used. The gas typically comprises air but other gases can also be used.

Once in the assembled state shown in FIG. 20, a stream of pressurized gas is delivered into channel 270 from gas supply 280 (FIG. 14). The pressurized gas stream drives projectile 18 down channel 270 and into compartment 126 of sabot 16. As projectile 18 travels down channel 270 and into compartment 126 the air within compartment 126 exits down through floor 138 of sabot 16 by passing through holes 144 (FIG. 12), passes out from between floor 138 and gas seal wad 14 by traveling along channels 62 (FIG. 5) formed on gas seal wad 14, and then passes up between the exterior surface of sabot 16 and the interior surface of channel 270 by traveling along channels 136 formed on the exterior surface sabot 16 (FIG. 11). But for the gas pathway formed by holes 144, channels 62, and channels 136, the air would be trapped within compartment 126 of sabot 16, and thereby prevent projectile 18 from entering compartment 126.

Figure 21:
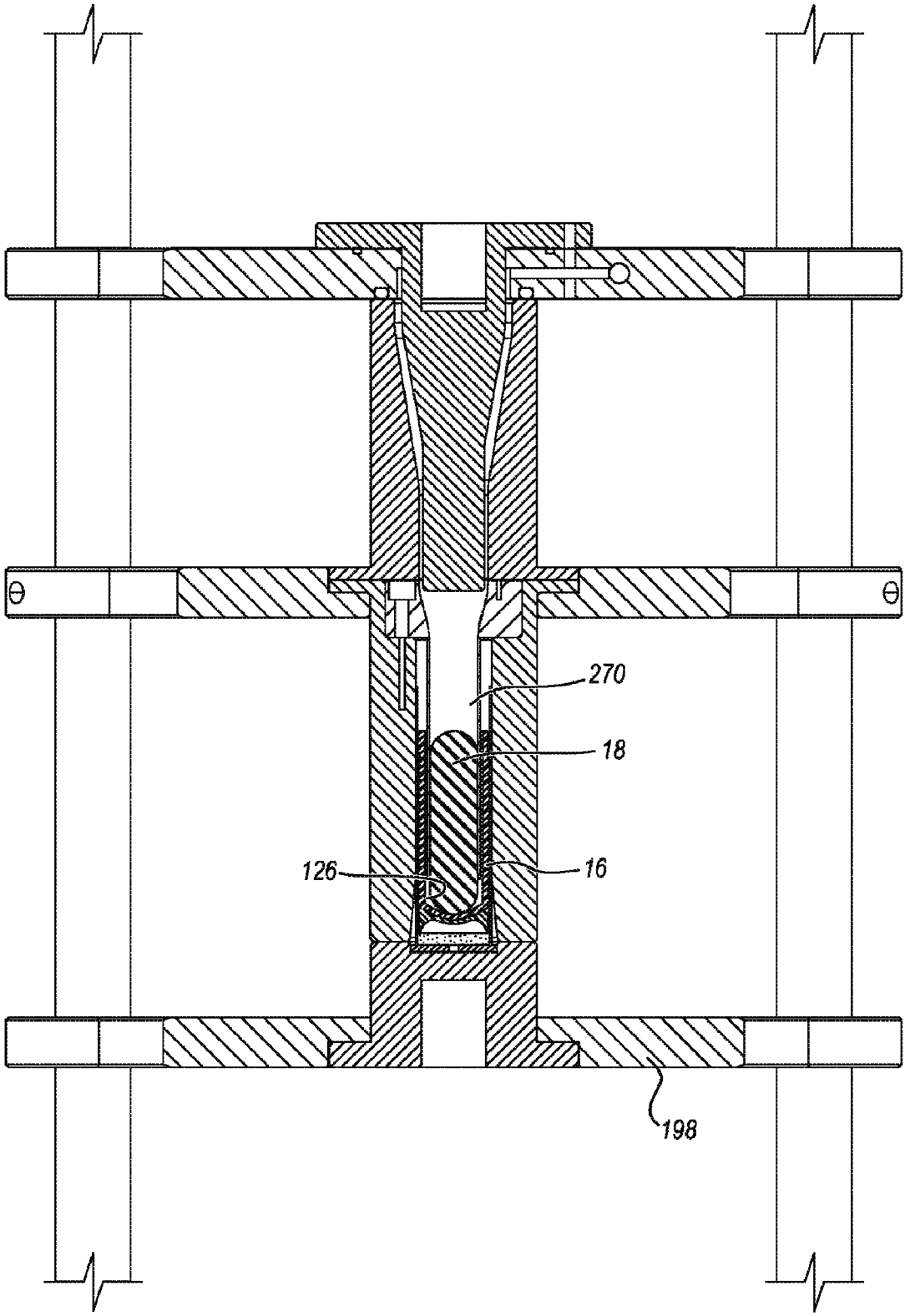
FIG. 21 is a cross sectional side view of the loading system shown in FIG. 20 wherein a pressurized gas is used to advance the projectile into the sabot.

As depicted in FIG. 21, once projectile 18 is resting on floor 138 of sabot 16, lower plate 198 is progressively lowered while the gas pressure is maintained against projectile 18. The gas pressure causes projectile 18 to be dispensed from the lower end of delivery tube 224 into compartment 126 of sabot 16 until delivery tube 224 is completely removed from compartment 126 and projectile 18 is completely disposed within compartment 126 as depicted in FIG. 22. The above process helps ensure that projectile 18 properly fills compartment 126 from floor 138 up.

Gas supply 280 and the examples herein of how it couples with channel 270 are examples of means for delivering a pressurized gas to channel 270 of delivery tube 224 so that the pressurized gas can push projectile 18 down through delivery tube 224 and into the chamber of the casing 12 when projectile 18 is positioned within delivery tube 224. In alternative examples of such means, the gas can be delivered through plunger 212 or through the side of delivery tube 224.

Once casing 12 is removed from support housing 222, fist end 36 of casing 12 can be closed by position overshot card 20 (FIG. 1) on top of sabot 16 and then crimping the free end of casing 12 over the top of overshot card 20. Other techniques known in the art of close the end of a shotgun shell can also be used.

It is appreciated that loading system 190 can be made in a variety of different configurations and can be operated in a variety of different manners. By way of example and not by limitation, plunger 212 (FIG. 18) primarily functions to seat projectile 18 within channel 270 so that when the gas pressure is applied, projectile 18 is driven down the length channel 270. As such, plunger 212 can be shorter or have a variety of different configurations. In yet other embodiments, plunder 212 can be eliminated. In this embodiment, projectile 18 is manually pressed down into channel 270 so as to seat against the interior surface thereof.

Furthermore, support housing 222 primary functions as a guide for directing casing 12 as sabot 16 receives stem 256. As such, housing 222 need not completely encircle casing 12 and, in some embodiments, housing 222 can be eliminated. Likewise, although loading system 190 is shown as comprising a multitude of parts that are secured together, it is appreciated that many of the parts that are secured together can be integrally formed as a single part or as fewer parts than presently depicted.

Finally, the present embodiment depicts loading system 190 where central plate 220 is stationary while lower plate 198 and upper plate 210 move relative thereto. In alternative embodiments, different plates can be designed to move while others are held stationary. For example. Lower plate 198 can be held stationary while central plate 220 and upper plate 210 are lowered. Alternatively, all three plate can be designed to move. It is appreciated that a variety of other non-essential modification can be made and still achieve the objective of the invention. For example, plates 198, 210 and 220 can have a variety of different configurations and can be used with a different number of guide rails 196. Likewise, guide rails 196 can be eliminated whether other centering mechanisms are used.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sabot comprising:

a base; and a plurality of elongated petals, each petal comprising:

an elongated sidewall portion having an interior surface and an arched exterior surface each extending between a first end and an opposing second end; and a floor portion inwardly projecting from the interior surface of the sidewall portion at the second end thereof so as to form an inside angle between the interior surface of the sidewall portion and an interior surface of the floor portion, each floor portion being pivotally connected to the base so that the plurality of petals can selectively move between a collapsed position wherein the sidewall portions combine to formal a substantially cylindrical sidewall that bounds a chamber and an expanded position wherein the sidewall portions radially outwardly project from the base.

2. The sabot as recited in claim 1, wherein the inside angle between the interior surface of the sidewall portion and an interior surface of the floor portion is less than 160°.

3. The sabot as recited in claim 1, wherein the floor portions and the base combine to form a substantially circular floor when the petals are in the collapsed position.

4. The sabot as recited in claim 3, wherein the floor has an opening extending therethrough so as to communicate with the chamber when the petals are in the collapsed position.

5. The sabot as recited in claim 3, wherein the floor has a substantially domed shaped configuration that projects away from the chamber when the petals are in the collapsed position.

6. The sabot as recited in claim 1, wherein each floor portion is connected to the base by a living hinge.

7. The sabot as recited in claim 1, further comprising means projecting from the interior surface of the sidewall portions for engaging a projectile comprised of an elastomeric material when an projectile is disposed within the chamber.

8. The sabot as recited in claim 1, wherein each sidewall portion has opposing first and second side edges that extend along the entire length of the sidewall portion, each side edge having a lip outwardly projecting along the length thereof or a recess formed along the length thereof, the lips and recesses being configured and positioned so that when the petals are in the collapsed position, the side edges of adjacent sidewall portions engage along the length thereof by having a lip received within a recess.

9. The sabot as recited in claim 1, wherein the plurality of elongated petals comprises three elongated petals and the base has a substantially triangular configuration.

10. A projectile cartridge comprising:

a casing comprising a tubular sleeve having an interior surface extending between a first end and an opposing second, a base being mounted at the second end of the tubular sleeve, the interior surface of the tubular sleeve bounding a compartment;

a gas seal wad disposed within the second end of the compartment of the casing;

a sabot as recited in claim 1 being disposed within the compartment of the casing adjacent to the gas seal wad; and a projectile compressed within the chamber of the sabot, the projectile being comprised of an elastomeric material.

11. The projectile cartridge as recited in claim 10, further comprising:

the gas seal wad having a top surface and an opposing bottom surface, the top surface having a cupped pocket formed thereon; and the floor portions and the base of the sabot combine to form a substantially circular floor having a substantially domed shaped configuration, the domed floor of the sabot being received within the cupped pocket of the gas seal wad.

* * * * *

UNITED STATES PATENT AND TRADEMARK OFFICE

CERTIFICATE OF CORRECTION

PATENT NO. : 7,743,709 B2
APPLICATION NO. : 11/927216
DATED : June 29, 2010
INVENTOR(S) : Kolnik et al.

It is certified that error appears in the above-identified patent and that said Letters Patent is hereby corrected as shown below:

Title Page,
Item 57, ABSTRACT, Line 12, change "formal" to --form--

Drawings
Sheet 9, replace Figure 16 with the figure depicted below, wherein reference number "220" has been inserted Signed and Sealed this Fourteenth Day of December, 2010

David J. Kappos

David J. Kappos
*Director of the United States Patent and Trademark Office*

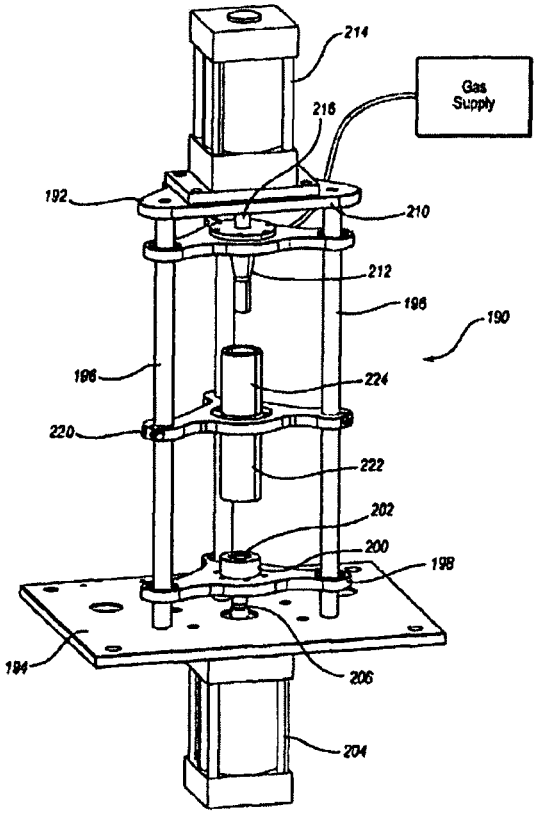

*Fig. 16*

Column 1
Line 28, change "compartment of sabot" to --compartment of the sabot--
Line 43, change "produce" to --producing--

Column 3
Line 10, change "accomplishes" to --accomplish--
Line 12, change "material as" to --material so as--
Line 47, change "particles" to --particle--

Column 4
Line 2, change "vales" to --values--
Line 12, change "posses" to --possess--

Column 6
Line 21, change "complimentary" to --complementary--
Line 46, change "complimentary" to --complementary--
Line 56, change "base 60" to --base 80--
Line 66, change "time" to --times--

Column 7
Line 4, change "of petals 82" to --of the petals 82--
Line 33, after "end face 132" insert --,--

Column 8
Line 50, change "helically" to --helical--

Column 9
Line 5, change "rube" to --rub--
Line 41, change "and a floor portions 154" to --and floor portions 154--
Line 54, change "petals 152A-B" to --petals 150A-B--
Lines 56-57, change "petals 152A-B" to --petals 150A-B--

Column 10
Line 6, change "contracts" to --contrast--
Line 49, change "complimentary" to --complementary--

Column 11
Line 43, change "so as to spaced" to --so as to be spaced--

Column 12
Line 1, after "invention" insert --,--
Line 4, change "is" to --of--
Line 5, change "annular seal 217" to --annular seal 271--
Line 11, after "224" insert --,--
Line 16, after "allows" remove [a]
Line 32, change "FIG. 14" to --FIG. 19--
Line 35, after "126" insert --,--
Line 65, change "fist" to --first--

Column 13
Line 2, change "art of close" to --art to close--
Line 11, change "plunder" to --plunger--
Line 15, change "primary" to --primarily--
Line 28, change "For example. Lower" to --For example, lower--
Line 30, change "all three plate" to --all three plates--
Line 60, change "formal" to --form--

Column 14
Line 23, change "when an projectile" to --when a projectile--
Line 39, change "second" to --second end--